US011011837B2

(12) United States Patent
Wu et al.

(10) Patent No.: US 11,011,837 B2
(45) Date of Patent: May 18, 2021

(54) COMMUNICATIONS TERMINAL

(71) Applicant: Huawei Technologies Co., Ltd., Shenzhen (CN)

(72) Inventors: Pengfei Wu, Shanghai (CN); Dong Yu, Shanghai (CN); Chien-Ming Lee, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/461,561

(22) PCT Filed: Nov. 17, 2016

(86) PCT No.: PCT/CN2016/106269
§ 371 (c)(1),
(2) Date: May 16, 2019

(87) PCT Pub. No.: WO2018/090295
PCT Pub. Date: May 24, 2018

(65) Prior Publication Data
US 2020/0058992 A1 Feb. 20, 2020

(51) Int. Cl.
*H01Q 1/24* (2006.01)
*H01Q 1/52* (2006.01)
(Continued)

(52) U.S. Cl.
CPC ..... *H01Q 1/523* (2013.01); *H01Q 1/243* (2013.01); *H01Q 1/48* (2013.01); *H01Q 21/0025* (2013.01)

(58) Field of Classification Search
CPC ..... H01Q 1/243; H01Q 1/44; H01Q 1/48; H01Q 1/52; H01Q 5/30–392; H01Q 1/24–48; H01Q 1/523
See application file for complete search history.

(56) References Cited

U.S. PATENT DOCUMENTS 8,907,853 B2 * 12/2014 Ying ..... H01Q 1/243 343/702
9,024,823 B2 * 5/2015 Bevelacqua ..... H01Q 9/42 343/702
(Continued)

FOREIGN PATENT DOCUMENTS

CN 102884680 A 1/2013
CN 102025022 B 7/2013
(Continued)

*Primary Examiner* — Hasan Z Islam
(74) *Attorney, Agent, or Firm* — Slater Matsil, LLP

(57) ABSTRACT

A communications terminal includes a multiple-input multiple-output antenna system. The multiple-input multiple-output antenna system includes a first antenna module, a second antenna module, and a first ground structure. The first antenna module includes a first radiator configured to form a first MIMO antenna and a second radiator configured to form a GPS antenna, and a first slit is provided between the first radiator and the second radiator. The second antenna module includes a third radiator configured to form a low frequency antenna and a fourth radiator configured to form a second MIMO antenna. The second radiator is connected to the third radiator. One end of the first ground structure is connected to the second radiator or the third radiator, and another end is connected to a ground plane of the communications terminal.

17 Claims, 17 Drawing Sheets

(51) Int. Cl.
*H01Q 1/48* (2006.01)
*H01Q 21/00* (2006.01)

(56) References Cited

U.S. PATENT DOCUMENTS

| | | | | |
|---|---|---|---|---|
| 10,200,092 | B1 * | 2/2019 | Irci | H04B 5/02 |
| 2010/0238079 | A1 | 9/2010 | Ayatollahi et al. | |
| 2012/0178382 | A1 | 7/2012 | Merz et al. | |
| 2013/0088400 | A1 | 4/2013 | Chen et al. | |
| 2013/0257674 | A1 | 10/2013 | Li et al. | |
| 2014/0139379 | A1 | 5/2014 | Bolin et al. | |
| 2014/0347242 | A1 | 11/2014 | Seo et al. | |
| 2015/0048979 | A1 * | 2/2015 | Asrani | H01Q 1/521 343/702 |
| 2015/0155614 | A1 | 6/2015 | Youn et al. | |
| 2015/0171916 | A1 | 6/2015 | Asrani et al. | |
| 2015/0303969 | A1 | 10/2015 | Lee et al. | |
| 2016/0064820 | A1 | 3/2016 | Kim et al. | |
| 2016/0233574 | A1 | 8/2016 | Xiong et al. | |
| 2016/0301145 | A1 | 10/2016 | Lee et al. | |
| 2017/0201010 | A1 | 7/2017 | Kim et al. | |
| 2018/0358699 | A1 | 12/2018 | Li et al. | |
| 2019/0036210 | A1 * | 1/2019 | Kim | G06F 1/203 |
| 2019/0051992 | A1 * | 2/2019 | Martiskainen | H01Q 21/28 |

FOREIGN PATENT DOCUMENTS

| | | | |
|---|---|---|---|
| CN | 203536554 | U | 4/2014 |
| CN | 103872424 | A | 6/2014 |
| CN | 104022353 | A | 9/2014 |
| CN | 104183918 | A | 12/2014 |
| CN | 104701618 | A | 6/2015 |
| CN | 105140623 | A | 12/2015 |
| CN | 105337022 | A | 2/2016 |
| CN | 205104610 | U | 3/2016 |
| CN | 105656499 | A | 6/2016 |
| CN | 105720355 | A | 6/2016 |
| CN | 105720995 | A | 6/2016 |
| CN | 105763214 | A | 7/2016 |
| CN | 105958201 | A | 9/2016 |
| CN | 108701889 | B | 2/2020 |
| EP | 2284944 | A1 | 2/2011 |
| EP | 3086408 | A1 | 10/2016 |
| JP | 2015109642 | A | 6/2015 |
| WO | 2015035854 | A1 | 3/2015 |

* cited by examiner

COMMUNICATIONS TERMINAL

CROSS-REFERENCE TO RELATED APPLICATIONS

This application is a U.S. National Stage of International Patent Application No. PCT/CN2016/106269, filed on Nov. 17, 2016, which is hereby incorporated by reference in its entirety, which application is hereby incorporated herein by reference.

TECHNICAL FIELD

The present invention relates to the field of communications technologies, and in particular, to a communications terminal including a multiple-input multiple-output antenna system.

BACKGROUND

With development of mobile communications technologies, terminals have increasingly high requirements on multiple-input multiple-output (Multi-input Multi-output, MIMO) antenna technologies, and quantities and frequency bands of MIMO antennas are also increasing. Currently, a 2*2 antenna system has gradually developed to a 4*4 antenna system. This poses a serious challenge on antenna design of a terminal having a metal body. A terminal (for example, a mobile phone) using a metal industrial design (Industrial Design, ID) generally requires very high structure compactness and a very large metal ratio. After a MIMO antenna is added, on one hand, space of an original communications antenna is compressed. On the other hand, a frequency band of the MIMO antenna is generally the same as a frequency band of the original communications antenna, resulting in deterioration of isolation of an antenna system. More importantly, in terms of a transmission feature of the MIMO antenna, a high requirement is posed on an antenna directivity pattern, and directivity patterns between antennas need to be complementary.

SUMMARY

Embodiments of the present invention provide a communications terminal including a multiple-input multiple-output antenna system, to increase isolation between a plurality of antennas by using a modular design of the antennas, improve complementarity between directivity patterns of the plurality of antennas, and improve radiation performance of the antenna system.

An embodiment of the present invention provides a communications terminal, including a multiple-input multiple-output antenna system, where the multiple-input multiple-output antenna system includes a first antenna module, a second antenna module, and a first ground structure. The first antenna module includes a first radiator and a second radiator, and a first slit is provided between the first radiator and the second radiator. The second antenna module includes a third radiator and a fourth radiator. The second radiator is connected to the third radiator, the first radiator is located on one side of the second radiator opposite to the third radiator, and the fourth radiator is located on one side of the third radiator opposite to the second radiator. The first radiator is configured to form a first MIMO antenna, the second radiator is configured to form a GPS antenna, the third radiator is configured to form a first low frequency communications antenna, and the fourth radiator is configured to form a second MIMO antenna. One end of the first ground structure is connected to at least one of the second radiator and the third radiator, and another end is connected to at least one ground plane of the communications terminal, to increase isolation between the first antenna module and the second antenna module.

In this embodiment, the first ground structure is disposed between the first antenna module and the second antenna module, so that isolation between the first MIMO antenna and the second MIMO antenna can be effectively increased. In addition, the first slit is provided between the first radiator and the second radiator, so that frequency coverage of the first antenna module can be effectively increased, and it may be ensured that the first radiator and the fourth radiator are isolated by at least one slit. This helps improve isolation of the multiple-input multiple-output antenna system.

In an implementation, the first antenna module further includes a first feeding port and a second feeding port; the first feeding port is connected to the first radiator, is configured to feed a first signal source, and forms the first MIMO antenna together with the first radiator; and the second feeding port is connected to the second radiator, is configured to feed a second signal source, and forms the GPS antenna together with the second radiator.

In this implementation, the first feeding port and the second feeding port are disposed, so that a multi-feed antenna form is formed inside the first antenna module, and a GPS frequency band is separated from another frequency band. This helps reduce design difficulty of the entire antenna system and improve directivity of the GPS antenna.

In an implementation, the first antenna module further includes a first band-pass filter, and the first band-pass filter is connected in parallel to the second feeding port, to increase isolation between the first radiator and the second radiator.

In this implementation, the first band-pass filter is connected in parallel to the second feeding port, so that isolation between the first MIMO antenna and the GPS antenna can be further improved.

In an implementation, the second antenna module further includes a third feeding port and a fourth feeding port; the third feeding port is connected to the third radiator, is configured to feed a third signal source, and forms the first low frequency communications antenna together with the third radiator; the fourth feeding port is connected to the fourth radiator, is configured to feed a fourth signal source, and forms the second MIMO antenna together with the fourth radiator; and a second slit is provided between the third radiator and the fourth radiator, to increase isolation between the third radiator and the fourth radiator.

In this implementation, the third feeding port and the fourth feeding port are disposed, so that a multi-feed antenna form is formed inside the second antenna module. This helps reduce the design difficulty of the entire antenna system. In addition, the second MIMO antenna is formed by using the fourth radiator, so that the second MIMO antenna is relatively far away from the first MIMO antenna at a spatial location. This helps improve isolation of the MIMO antenna system.

In an implementation, the second antenna module further includes a second band-pass filter, and the second band-pass filter is connected in parallel to the third feeding port, to increase the isolation between the third radiator and the fourth radiator.

In this implementation, the second band-pass filter is connected in parallel to the third feeding port, so that isolation between the first low frequency communications antenna and the second MIMO antenna can be further improved.

In an implementation, the another end of the first ground structure is connected to at least two ground planes of the communications terminal, to form a three-dimensional isolation structure between the first antenna module and the second antenna module, and the at least two ground planes include at least two of a front-cover ground plane, a rear-cover ground plane, and a reference ground plane of radio frequency circuits of the communications terminal.

In this implementation, the another end of the first ground structure is connected to at least two of the front-cover ground plane, the rear-cover ground plane, and the reference ground plane of the radio frequency circuits of the communications terminal, so that the three-dimensional isolation structure is formed between the first antenna module and the second antenna module. This helps further improve an isolation effect of the first ground structure.

In an implementation, the multiple-input multiple-output antenna system further includes a third antenna module, a fourth antenna module, and a second ground structure. The third antenna module includes a fifth radiator and a sixth radiator, and a third slit is provided between the fifth radiator and the sixth radiator. The fourth antenna module includes a seventh radiator and an eighth radiator, the sixth radiator is connected to the seventh radiator, the fifth radiator is located on one side of the sixth radiator opposite to the seventh radiator, and the eighth radiator is located on one side of the seventh radiator opposite to the sixth radiator. The fifth radiator and the sixth radiator are configured to form a third MIMO antenna, the seventh radiator is configured to form a second low frequency communications antenna, and the eighth radiator is configured to form a fourth MIMO antenna. One end of the second ground structure is connected to at least one of the sixth radiator and the seventh radiator, and another end is connected to at least one ground plane of the communications terminal, to increase isolation between the third antenna module and the fourth antenna module.

In this implementation, the second ground structure is disposed between the third antenna module and the fourth antenna module, so that isolation between the third MIMO antenna and the fourth MIMO antenna can be effectively increased. In addition, the third slit is provided between the fifth radiator and the sixth radiator, so that it may be ensured that the fifth radiator and the eighth radiator are isolated by at least one slit. This helps further improve the isolation of the multiple-input multiple-output antenna system.

In an implementation, the third antenna module further includes a fifth feeding port; the fifth feeding port is connected to the fifth radiator, is configured to feed a fifth signal source, and forms the third MIMO antenna together with the fifth radiator and the sixth radiator; and the sixth radiator is coupled to the fifth radiator through the third slit.

In this implementation, because a bottom end of the communications terminal does not include the GPS frequency band, the third antenna module is set to a single-feed antenna form, and the sixth radiator is set to a coupling branch. This helps reduce the design difficulty of the entire antenna system.

In an implementation, the fourth antenna module further includes a sixth feeding port and a seventh feeding port; the sixth feeding port is connected to the seventh radiator, is configured to feed a sixth signal source, and forms the second low frequency communications antenna together with the seventh radiator; the seventh feeding port is connected to the eighth radiator, is configured to feed a seventh signal source, and forms the fourth MIMO antenna together with the eighth radiator; and a fourth slit is provided between the seventh radiator and the eighth radiator, to increase isolation between the seventh radiator and the eighth radiator.

In this implementation, the sixth feeding port and the seventh feeding port are disposed, so that a multi-feed antenna form is formed inside the fourth antenna module. This helps reduce the design difficulty of the entire antenna system. In addition, the fourth MIMO antenna is formed by using the eighth radiator, so that the fourth MIMO antenna is relatively far away from the third MIMO antenna at a spatial location. This helps improve the isolation of the MIMO antenna system.

In an implementation, the fourth antenna module further includes a third band-pass filter, and the third band-pass filter is connected in parallel to the sixth feeding port, to increase the isolation between the seventh radiator and the eighth radiator.

In this implementation, the third band-pass filter is connected in parallel to the sixth feeding port, so that isolation between the second low frequency communications antenna and the fourth MIMO antenna can be further improved.

In an implementation, the another end of the second ground structure is connected to at least two ground planes of the communications terminal, to form a three-dimensional isolation structure between the third antenna module and the fourth antenna module, and the at least two ground planes are at least two of the front-cover ground plane, the rear-cover ground plane, and the reference ground plane of the radio frequency circuits of the communications terminal.

In this implementation, the another end of the second ground structure is connected to at least two of the front-cover ground plane, the rear-cover ground plane, and the reference ground plane of the radio frequency circuits of the communications terminal, so that the three-dimensional isolation structure is formed between the third antenna module and the fourth antenna module. This helps further improve an isolation effect of the second ground structure.

In an implementation, the communications terminal further includes a metal frame, the metal frame includes a top metal frame, a bottom metal frame, a first-side metal frame, and a second-side metal frame, the top metal frame and the bottom metal frame are disposed opposite to each other, the first-side metal frame and the second-side metal frame are respectively connected to two ends of the top metal frame and the bottom metal frame, and the first radiator to the eighth radiator each are a part of the metal frame.

In an implementation, the first radiator is a part of the top metal frame and a part of the first-side metal frame that are of the communications terminal, the second radiator and the third radiator are parts of the top metal frame of the communications terminal, the fourth radiator is a part of the top metal frame and a part of the second-side metal frame that are of the communications terminal, a fifth slit is provided between the part of the first-side metal frame used as the first radiator and the remaining first-side metal frame, and a sixth slit is provided between the part of the second-side metal frame used as the fourth radiator and the remaining second-side metal frame.

In an implementation, the fifth radiator is a part of the bottom metal frame and a part of the second-side metal frame that are of the communications terminal, the sixth radiator and the seventh radiator are parts of the bottom metal frame of the communications terminal, the eighth radiator is a part of the bottom metal frame and a part of the first-side metal frame that are of the communications terminal, a seventh slit is provided between the part of the second-side metal frame used as the fifth radiator and the remaining second-side metal frame, and an eighth slit is provided between the part of the first-side metal frame used as the eighth radiator and the remaining first-side metal frame.

In an implementation, the first radiator is a part of the first-side metal frame of the communications terminal, the second radiator is a part of the top metal frame and a part of the first-side metal frame that are of the communications terminal, the third radiator is a part of the top metal frame and a part of the second-side metal frame that are of the communications terminal, and the fourth radiator is a part of the second-side metal frame of the communications terminal.

In an implementation, the fifth radiator is a part of the second-side metal frame of the communications terminal, the sixth radiator is a part of the bottom metal frame and a part of the second-side metal frame that are of the communications terminal, the seventh radiator is a part of the bottom metal frame and a part of the first-side metal frame that are of the communications terminal, and the eighth radiator is a part of the first-side metal frame of the communications terminal.

A part of the metal frame of the communications terminal is used as a radiator of each antenna module of the multiple-input multiple-output antenna system. This helps improve the radiation performance of the antenna system. In addition, a location at which a slit is provided is flexibly disposed, so that designs satisfying different requirements can be achieved while ensuring the radiation performance of the antennas. This helps improve product quality of the communications terminal.

In an implementation, a frequency band covered by the first low frequency communications antenna includes at least 700 MHz to 960 MHz, and a frequency band covered by the first MIMO antenna and the second MIMO antenna includes at least 1700 MHz to 2700 MHz.

In an implementation, in a seventeenth possible implementation of a first aspect, a frequency band covered by the second low frequency communications antenna includes at least 700 MHz to 960 MHz, and a frequency band covered by the third MIMO antenna and the fourth MIMO antenna includes at least 1700 MHz to 2700 MHz.

BRIEF DESCRIPTION OF THE DRAWINGS

To describe the technical solutions in the embodiments of the present invention more clearly, the following briefly describes the accompanying drawings required for describing the embodiments.

DETAILED DESCRIPTION OF ILLUSTRATIVE EMBODIMENTS

Figure 1:
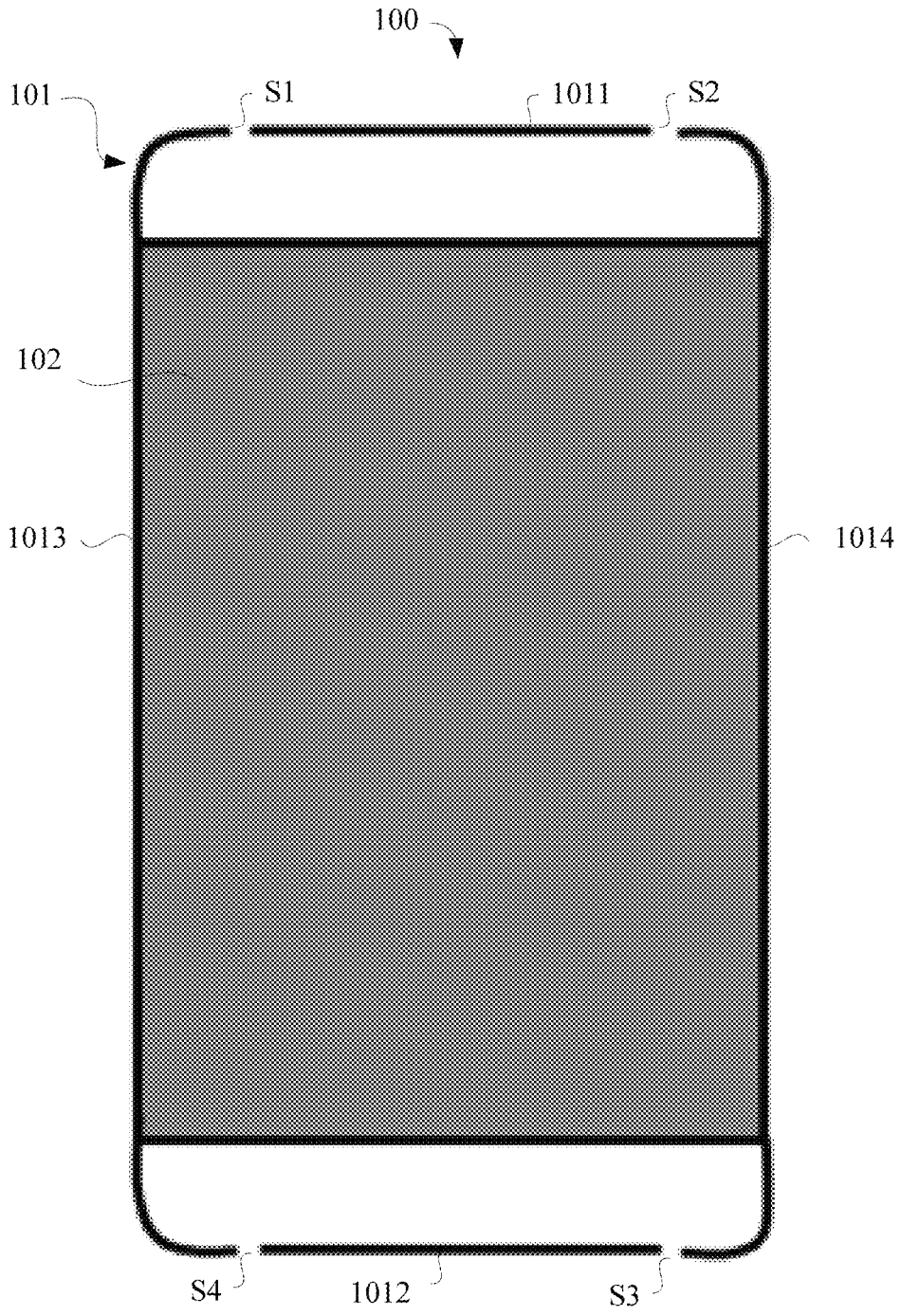
FIG. 1 is a first schematic structural diagram of a communications terminal according to an embodiment of the present invention.

The following describes the technical solutions in the embodiments of the present invention with reference to the accompanying drawings in the embodiments of the present invention.

Embodiments of the present invention provide a communications terminal having a layout design of a novel multiple-input multiple-output antenna system, so that relatively desirable multiple-input multiple-output (Multi-input Multi-output, MIMO) antenna system performance is achieved on a communications terminal using a metal industrial design (Industrial Design, ID). In addition, directivity of a Global Positioning System (Global Positioning System, GPS) antenna and a Wi-Fi antenna, and multi-carrier aggregation (Carrier Aggregation, CA) performance of an LTE frequency band are also optimized.

On one hand, a modular design of an antenna is used, for example, a top metal frame of the communications terminal is divided into two antenna modules (a GPS and/or Wi-Fi antenna module or a communications antenna module), and MIMO antennas in a same frequency band are designed in different antenna modules, to ensure that the MIMO antennas are isolated by at least one slotted slit. In addition, a ground structure is designed at a location near two antenna modules, so that isolation between the MIMO antennas is further improved. Because the MIMO antennas are located on two sides of the ground structure, directivity patterns can be more complementary.

On the other hand, inside an antenna module, a MIMO antenna may be combined with an original communications antenna or a GPS/Wi-Fi antenna, to form a single-feed antenna, or may be designed to be a multi-feed antenna. Generally, because the single-feed antenna is relatively difficult to design, some special frequency bands (GPS or a low frequency communication frequency band) may be separated out to form a multi-feed antenna system inside the antenna module, so that design difficulty of each antenna is reduced, directivity of the GPS antenna and the Wi-Fi antenna is improved, and multi-CA performance in Long Term Evolution (Long-Term Evolution, LTE) communication is better improved. In addition, because operating frequency bands of multi-feed antennas do not overlap, isolation between the antennas can be better improved and optimized.

It may be understood that the technical solutions provided in the embodiments of the present invention may be applied to various communications systems currently used by the communications terminal, for example, GSM, CDMA, WCDMA, GPRS, LTE, LTE-A, and UMTS, and technical solutions in the following embodiments are not used to limit requirements of a communications network, and are merely used to describe an operating feature of an antenna in frequency bands of different values. The embodiments of the present invention may be applied to communications terminals using a plurality of IDs, and the embodiments are described mainly by using an example in which top and bottom metal frames of a communications terminal using a metal ID have a double-slotted slit.

Referring to FIG. 1, in an embodiment of the present invention, a communications terminal 100 is provided. The communications terminal 100 includes a metal frame 101 and a rear-cover ground plane 102. The metal frame 101 includes a top metal frame 1011, a bottom metal frame 1012, a first-side metal frame 1013, and a second-side metal frame 1014. The top metal frame 1011 and the bottom metal frame 1012 are disposed opposite to each other. The first-side metal frame 1013 is connected to one end of the top metal frame 1011 and one end of the bottom metal frame 1012 in a round-cornered manner, and the second-side metal frame 1014 is connected to the other end of the top metal frame 1011 and the other end of the bottom metal frame 1012 in a round-cornered manner, to jointly form a round-cornered rectangular area. The rear-cover ground plane 102 is disposed in the rectangular area having fillets, and is separately connected to the first-side metal frame 1012 and the second-side metal frame 1014. It may be understood that the rear-cover ground plane 102 may be a metal back cover of the communications terminal 100.

A first slit S1 and a second slit S2 are respectively provided at locations of the top metal frame ion adjacent to fillets at two ends of the top metal frame 1011, and a third slit S3 and a fourth slit S4 are respectively provided at locations of the bottom metal frame 1012 adjacent to fillets at two ends of the bottom metal frame 1012. The first slit S1, the second slit S2, the third slit S3, and the fourth slit S4 are distributed on the metal frame 101 in a clockwise direction. It may be understood that, during actual application, the locations of the first slit S1, the second slit S2, the third slit S3, and the fourth slit S4 may be changed as required, and the slits may be filled in with a non-conducting material (for example, plastic), to ensure appearance integrity of the metal frame 101.

Figure 2:
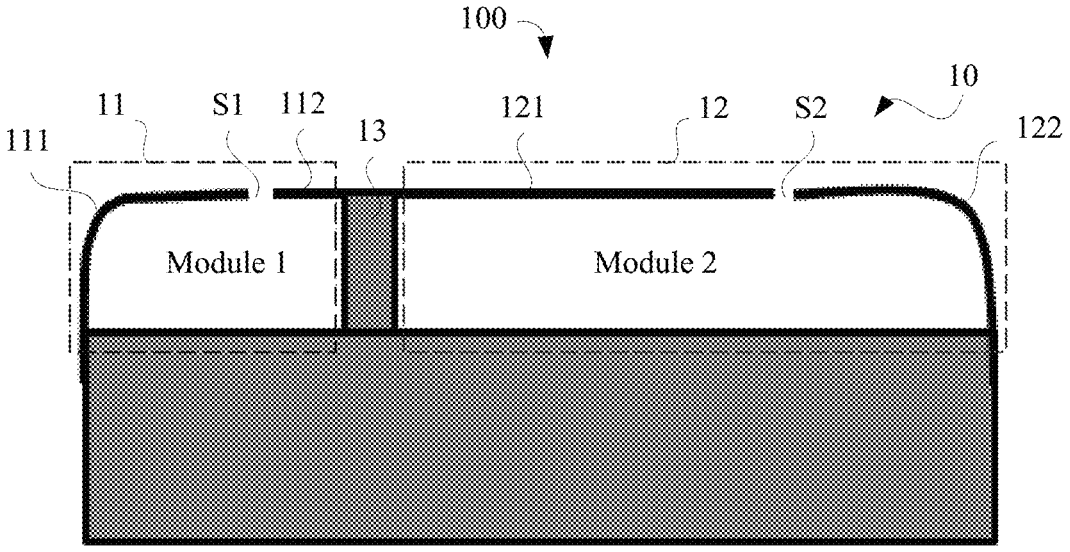
FIG. 2 is a first schematic structural diagram of a top antenna system of a communications terminal according to an embodiment of the present invention.

Referring to FIG. 2, the communications terminal 100 further includes a multiple-input multiple-output antenna system 10. The multiple-input multiple-output antenna system 10 includes a first antenna module 11, a second antenna module 12, and a first ground structure 13.

The first antenna module 11 includes a first radiator in and a second radiator 112, and a first slit S1 is provided between the first radiator in and the second radiator 112.

The second antenna module 12 includes a third radiator 121 and a fourth radiator 122, and a second slit S2 is provided between the third radiator 121 and the fourth radiator 122.

The second radiator 112 is connected to the third radiator 121, the first radiator in is located on one side of the second radiator 112 opposite to the third radiator 121, and the fourth radiator 122 is located on one side of the third radiator 121 opposite to the second radiator 112.

The first radiator in is configured to form a first MIMO antenna, the second radiator 112 is configured to form a GPS antenna, the third radiator 121 is configured to form a first low frequency communications antenna, and the fourth radiator 122 is configured to form a second MIMO antenna.

One end of the first ground structure 13 is connected to at least one of the second radiator 112 and the third radiator 121, and another end of the first ground structure 13 may be connected to at least one ground plane of the communications terminal 100. For example, the another end of the first ground structure 13 may be connected to any one or more of a front-cover ground plane (not shown), a rear-cover ground plane 102, and a reference ground plane (not shown) of radio frequency circuits of the communications terminal 100. When the another end of the first ground structure 13 is connected to at least two ground planes of the communications terminal 100, a three-dimensional isolation structure may be formed between the first antenna module 11 and the second antenna module 12, to increase isolation between the first antenna module 11 and the second antenna module 12.

Figure 3:
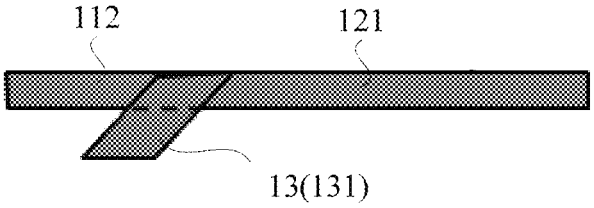
FIG. 3 is a first schematic structural diagram of a ground structure of a top antenna system of a communications terminal according to an embodiment of the present invention.
Figure 4:
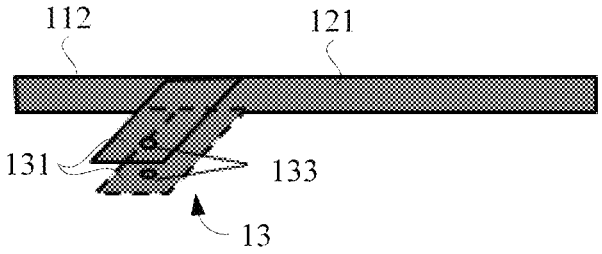
FIG. 4 is a second schematic structural diagram of a ground structure of a top antenna system of a communications terminal according to an embodiment of the present invention.

Referring to FIG. 3 and FIG. 4, the first ground structure 13 may include one metal sheet 131 (shown in FIG. 3) or a plurality of metal sheets 131 (shown in FIG. 4). If the first ground structure 13 includes the plurality of metal sheets 131, the plurality of metal sheets 131 may be disposed in parallel to the rear-cover ground plane 102 of the communications terminal 100, and aligned with each other and disposed at intervals in a direction perpendicular to the rear-cover ground plane 102. Specifically, one end of each one of the plurality of metal sheets 131 may be connected to at least one of the second radiator 112 and the third radiator 121, the other end of each one of the plurality of metal sheets 131 is connected to each one of a plurality of ground planes of the communications terminal 100, and each one of the plurality of metal sheets 131 may alternatively be connected to one end of each one of the plurality of ground planes by using a metal dome 133, to form a three-dimensional isolation structure and further improve an isolation effect.

Figure 5:
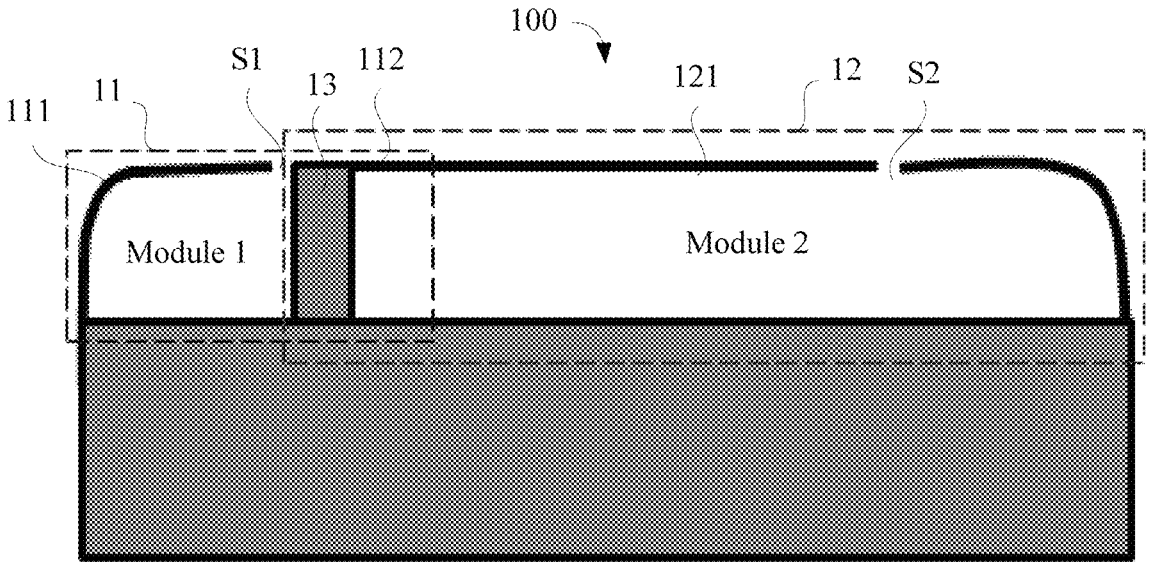
FIG. 5 is a second schematic structural diagram of a top antenna system of a communications terminal according to an embodiment of the present invention.
Figure 6:
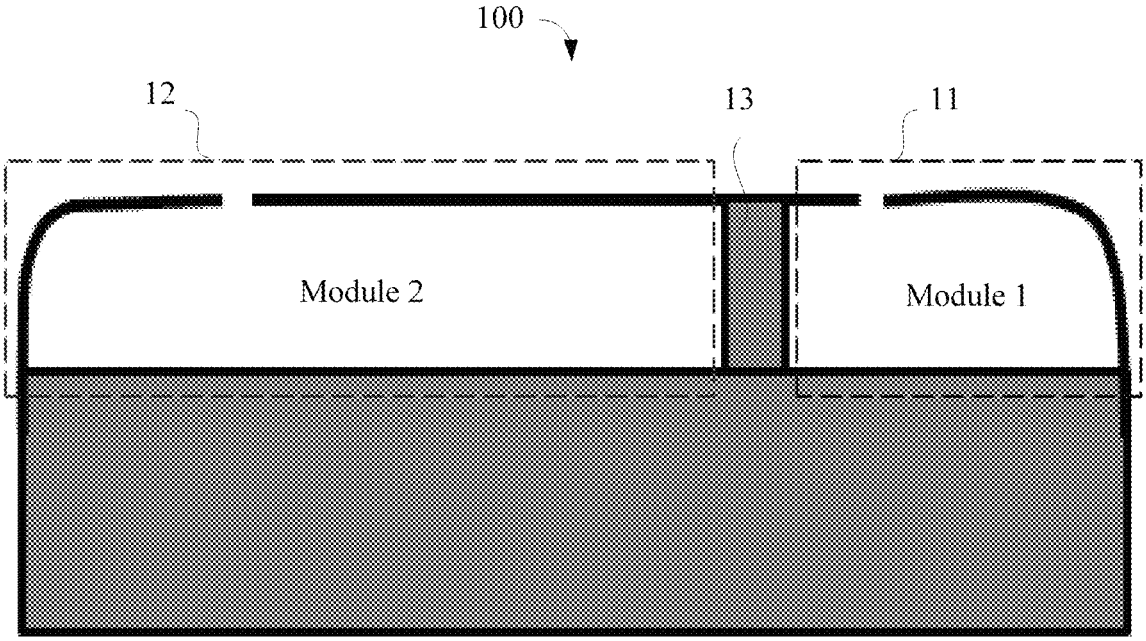
FIG. 6 is a third schematic structural diagram of a top antenna system of a communications terminal according to an embodiment of the present invention.

The communications terminal 100 may be a mobile phone, a tablet computer, or the like. Both the first antenna module 11 and the second antenna module 12 are located on a top of the communications terminal 100, and the first ground structure 13 may be located between the first antenna module 11 and the second antenna module 12, shown in FIG. 2. Alternatively, the first ground structure 13 may be located inside the first antenna module 11 or the second antenna module 12, as shown in FIG. 5. The first ground structure 13 is disposed at an edge location of the first slit S1, and a part of the third radiator 121 adjacent to the first ground structure 13 is reused as the second radiator 112, so that the ground structure 13 is located inside the first antenna module 1. In addition, arrangements of the first antenna module 11 and the second antenna module 12 on the top of the communications terminal 100 may alternatively be interchangeable, as shown in FIG. 6. In this embodiment, the first radiator in, the second radiator 112, the third radiator 121, and the fourth radiator 122 each are a part of the metal frame 101. It may be understood that the first radiator 111, the second radiator 112, the third radiator 121, and the fourth radiator 122 may alternatively be independent built-in radiators disposed on the top of the communications terminal 100, or some of the radiators are the metal frame 101 and some of the radiators are independent radiators.

Figure 7:
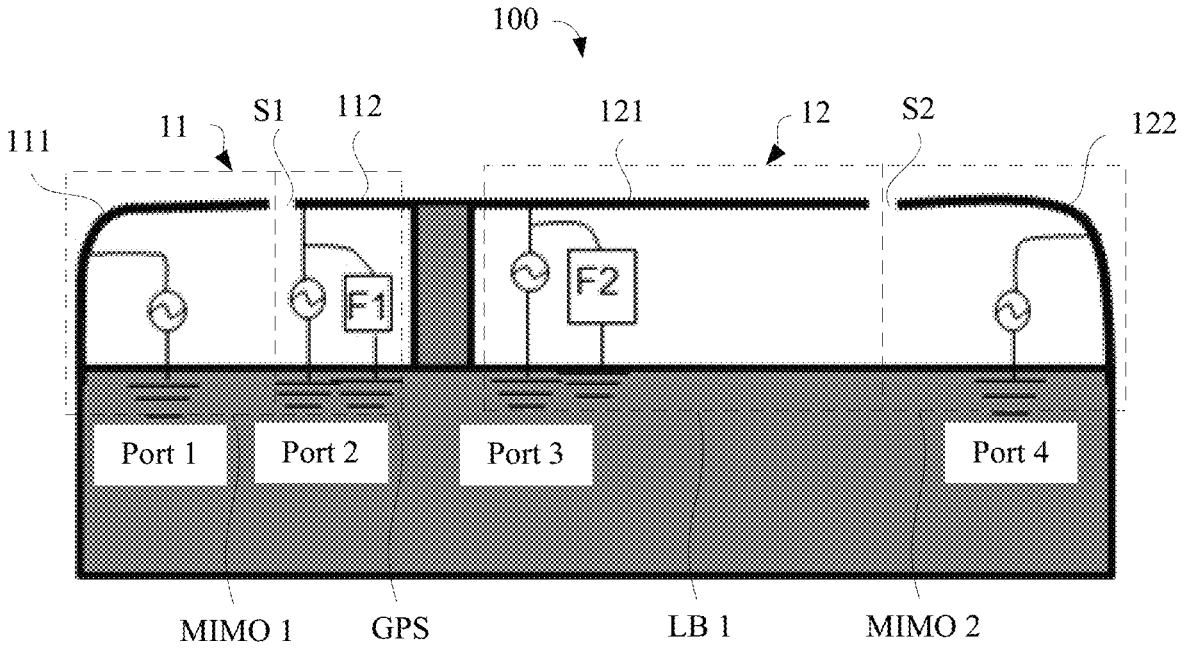
FIG. 7 is a fourth schematic structural diagram of a top antenna system of a communications terminal according to an embodiment of the present invention.

Referring to FIG. 7, in an implementation, the first antenna module 11 further includes a first feeding port 1 and a second feeding port 2. The first feeding port 1 is connected to the first radiator 111, is configured to feed a first signal source, and forms the first MIMO antenna together with the first radiator 111. The second feeding port 2 is connected to the second radiator 112, is configured to feed a second signal source, and forms the GPS antenna together with the second radiator 112. The second antenna module 12 further includes a third feeding port 3 and a fourth feeding port 4. The third feeding port 3 is connected to the third radiator 121, is configured to feed a third signal source, and forms the first low frequency communications antenna together with the third radiator 121. The fourth feeding port 4 is connected to the fourth radiator 122, is configured to feed a fourth signal source, and forms the second MIMO antenna together with the fourth radiator 122.

Specifically, after antennas on the top of the communications terminal 100 are classified into the first antenna module 11 and the second antenna module 12, an antenna inside each module may be designed to be a single-feed or multi-feed antenna. Referring to FIG. 7, in an implementation, an antenna frequency band covered by the first antenna module 11 includes a GPS frequency band and a first MIMO antenna MIMO 1 frequency band (for example, which may include at least a Wi-Fi communication frequency band and intermediate and high frequency communication frequency bands that are within a range of 1700 MHz to 2700 MHz). If the first antenna module 11 is designed to be a multi-feed antenna, because the GPS frequency band is relatively low, and a function of the GPS frequency band differs from that of another communication frequency band, the ground structure may be used in combination with the second radiator 112 to individually feed power, to cover the GPS frequency band. Correspondingly, the ground structure may be used in combination with the first radiator 111 to individually feed power, to cover the MIMO 1 frequency band. An antenna frequency band covered by the second antenna module 12 includes a first low frequency communication frequency band LB 1 (for example, which may include at least an LTE low frequency communication frequency band within a range of 700 MHz to 960 MHz) and a second MIMO antenna MIMO 2 frequency band (for example, which may include at least a Wi-Fi communication frequency band and intermediate and high frequency communication frequency bands that are within a range of 1700 MHz to 2700 MHz). If the second antenna module 12 is designed to be a multi-feed antenna, the third radiator 121 may be used to individually feed power, to cover the LB 1 frequency band. Correspondingly, the fourth radiator 122 may be used to individually feed power, to cover the MIMO 2 frequency band. In this way, a spatial distance between the MIMO 1 and the MIMO 2 is increased, so that isolation between multiple-input multiple-output antennas and complementarity of directivity patterns are better improved.

Referring to FIG. 7, in an implementation, the first antenna module further includes a first band-pass filter F1, and the first band-pass filter F1 is connected in parallel to the second feeding port 2, to increase isolation between the first radiator 111 and the second radiator 112. The second antenna module 12 further includes a second band-pass filter F2, and the second band-pass filter F2 is connected in parallel to the third feeding port 3, to increase isolation between the third radiator 121 and the fourth radiator 122.

The first band-pass filter F1 operating in an intermediate frequency communication frequency band (for example, 2 GHz) is connected in parallel to the feeding port 2 of the GPS antenna, to filter out an intermediate frequency signal of the first MIMO antenna that is coupled to the GPS antenna through the first slit S1, so that isolation between the GPS antenna and the MIMO 1 can be further improved. Similarly, the second band-pass filter F2 operating in an intermediate frequency communication frequency band (for example, 1.8 GHz) is connected in parallel to the feeding port 3 of the first low frequency communications antenna, to filter out an intermediate frequency signal of the second MIMO antenna that is coupled to the first low frequency communications antenna through the second slit S2, so that isolation between the first low frequency communications antenna and the MIMO 2 can be further improved. It may be understood that the method for improving isolation between antennas inside a module is not limited to the foregoing methods in which isolation is improved by adding a filter.

Figure 8:
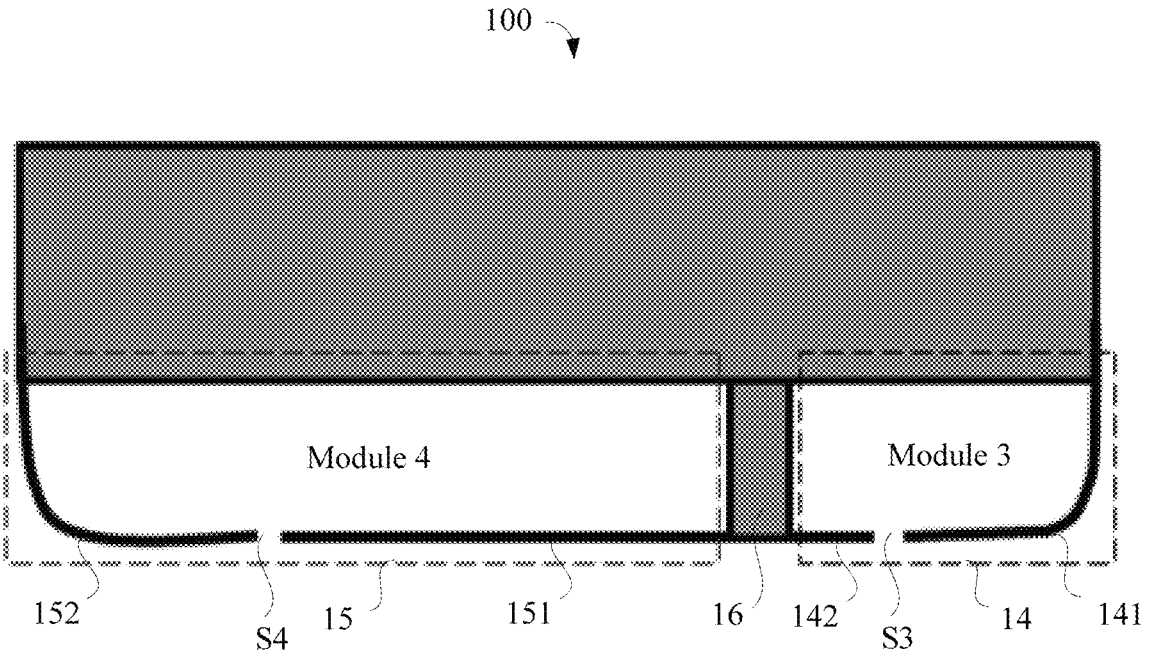
FIG. 8 is a first schematic structural diagram of a bottom antenna system of a communications terminal according to an embodiment of the present invention.
Figure 9:
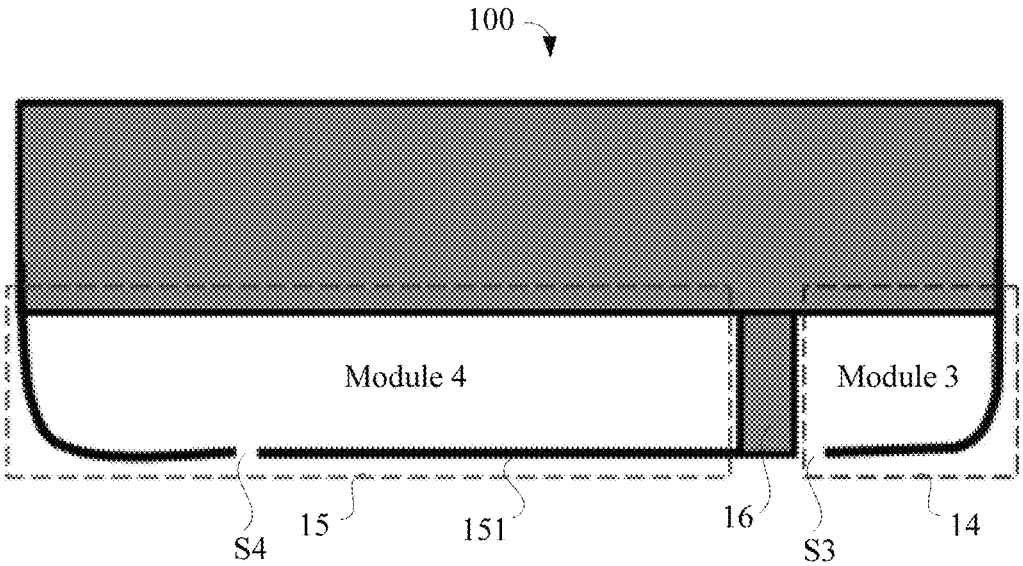
FIG. 9 is a second schematic structural diagram of a bottom antenna system of a communications terminal according to an embodiment of the present invention.

Referring to FIG. 8, in an implementation, the multiple-input multiple-output antenna system 10 further includes a third antenna module 141, a fourth antenna module 15, and a second ground structure 16.

The third antenna module 14 includes a fifth radiator 141 and a sixth radiator 142, and a third slit S3 is provided between the fifth radiator 141 and the sixth radiator 142.

The fourth antenna module 15 includes a seventh radiator 151 and an eighth radiator 152, the sixth radiator 142 is connected to the seventh radiator 151, the fifth radiator 141 is located on one side of the sixth radiator 142 opposite to the seventh radiator 151, and the eighth radiator 152 is located on one side of the seventh radiator 151 opposite to the sixth radiator 142.

The fifth radiator 141 and the sixth radiator 142 are configured to form a third MIMO antenna, the seventh radiator 151 is configured to form a second low frequency communications antenna, and the eighth radiator 152 is configured to form a fourth MIMO antenna.

One end of the second ground structure 16 is connected to at least one of the sixth radiator 142 and the seventh radiator 151, and another end of the second ground structure 16 may be connected to at least one ground plane of the communications terminal 100. For example, the another end of the second ground structure 16 may be connected to any one or more of the front-cover ground plane (not shown), the rear-cover ground plane 102, and the reference ground plane (not shown) of the radio frequency circuits of the communications terminal 100. When the another end of the second ground structure 16 is connected to at least two ground planes of the communications terminal 100, a three-dimensional isolation structure may be formed between the third antenna module 14 and the fourth antenna module 15, to increase isolation between the third antenna module 14 and the fourth antenna module 15. It may be understood that for a specific structure and a connection manner of the second ground structure 16, refer to the descriptions of the first ground structure 13 in the embodiments of FIG. 3 and FIG. 4, and details are not described herein again.

The third antenna module 14 and the fourth antenna module 15 are located at a bottom of the communications terminal 100. The second ground structure 16 may be located between the third antenna module 14 and the fourth antenna module 15, or may be located inside the third antenna module 14 or the fourth antenna module 15. For details, refer to the related descriptions of the location of the first ground structure 13, and details are not described herein again. In addition, arrangements of the third antenna module 14 and the fourth antenna module 15 at the bottom of the communications terminal 100 may alternatively be interchangeable. In this embodiment, the fifth radiator 141, the sixth radiator 142, the seventh radiator 151, and the eighth radiator 152 each are a part of the metal frame 101. It may be understood that the fifth radiator 141, the sixth radiator 142, the seventh radiator 151, and the eighth radiator 152 may alternatively be independent built-in radiators disposed at the bottom of the communications terminal 100, or some of the radiators are the metal frame 101 and some of the radiators are independent radiators.

Figure 10:
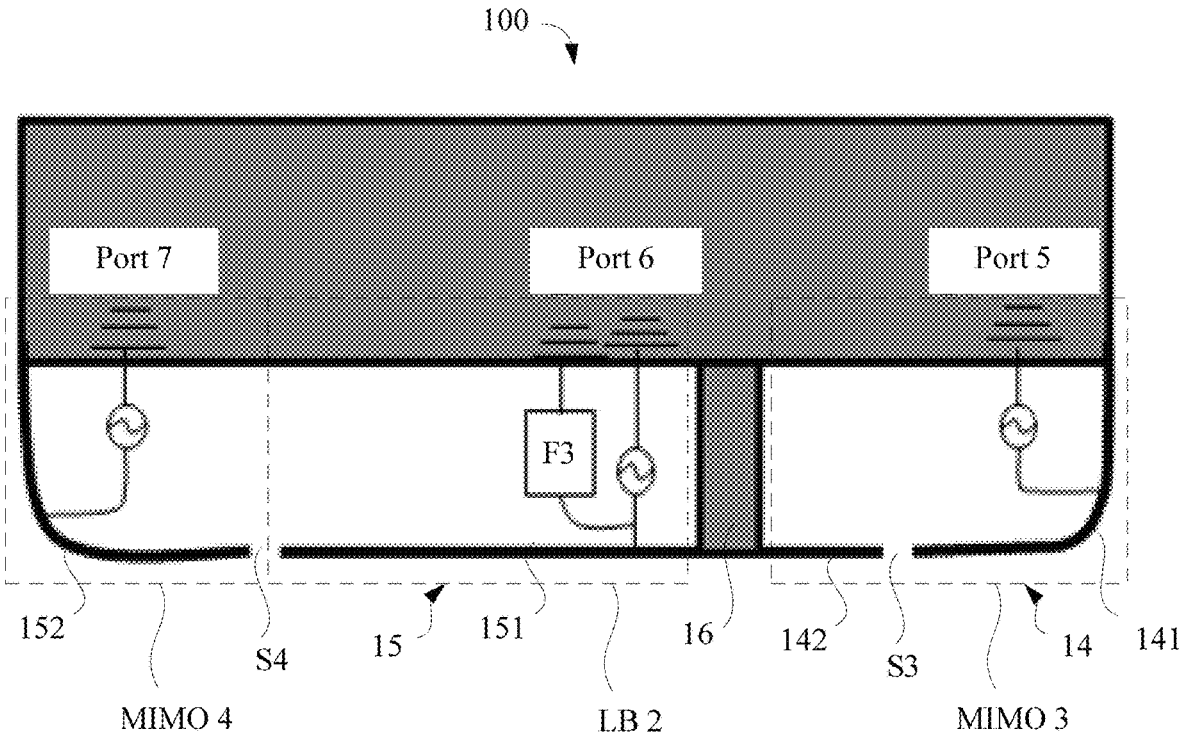
FIG. 10 is a third schematic structural diagram of a bottom antenna system of a communications terminal according to an embodiment of the present invention.

Referring to FIG. 10, in an implementation, the third antenna module 14 further includes a fifth feeding port 5. The fifth feeding port 5 is connected to the fifth radiator 141, is configured to feed a fifth signal source, and forms the third MIMO antenna together with the fifth radiator 141 and the sixth radiator 142. The sixth radiator 142 is coupled to the fifth radiator 141 through the third slit S3. The fourth antenna module 15 further includes a sixth feeding port 6 and a seventh feeding port 7. The sixth feeding port 6 is connected to the seventh radiator 151, is configured to feed a sixth signal source, and forms the second low frequency communications antenna together with the seventh radiator 151. The seventh feeding port 7 is connected to the eighth radiator 152, is configured to feed a seventh signal source, and forms the fourth MIMO antenna together with the eighth radiator 152.

A method for implementing the bottom antenna system of the communications terminal 100 is similar to the method for designing the top antenna system. The bottom antenna system of the communications terminal 100 is divided into two antenna modules by using the second ground structure 16: the third antenna module 14 and the fourth antenna module 15. Because the bottom antennas do not include a GPS frequency band, compared with the top antennas, it is more convenient to design the antennas inside the modules. In this embodiment, an antenna frequency band that may be covered by the third antenna module 14 includes a third MIMO antenna MIMO 3 frequency band (for example, which may include at least a Wi-Fi communication frequency band and intermediate and high frequency communication frequency bands that are within a range of 1700 MHz to 2700 MHz). An antenna frequency band that may be covered by the fourth antenna module 15 includes a second low frequency communication frequency band LB 2 (for example, which may include at least an LTE low frequency communication frequency band within a range of 700 MHz to 960 MHz) and a fourth MIMO antenna MIMO 4 frequency band (for example, which may include at least a Wi-Fi communication frequency band and intermediate and high frequency communication frequency bands that are within a range of 1700 MHz to 2700 MHz). Specifically, the third antenna module 14 may be designed to be a single-feed antenna. To be specific, the fifth radiator 141 at one side of the third slit S3 relative to the second ground structure 16 is used to independently feed power, and the sixth radiator 142 is used as an antenna coupling unit, to cover the MIMO 3 frequency band. The fourth antenna module 15 may use a method similar to the method for designing the second antenna module 12. To be specific, the LB 2 and the MIMO 4 are designed to be multi-feed antennas, specifically as shown in FIG. 10.

Referring to FIG. 10, in an implementation, the fourth antenna module 15 further includes a third band-pass filter F3. The third band-pass filter F3 is connected in parallel to the sixth feeding port 6, to filter out an intermediate frequency signal of the fourth MIMO antenna that is coupled to the second low frequency communications antenna through the fourth slit S4, so that isolation between the seventh radiator 151 and the eighth radiator 152 is increased. It may be understood that the third band-pass filter F3 operating in an intermediate frequency communication frequency band (for example, 1.8 GHz) is connected in parallel to the sixth feeding port 6, so that isolation between the second low frequency communications antenna and the MIMO 4 can be further improved.

In this embodiment of the present invention, according to the multiple-input multiple-output antenna system 10 that is formed by using the foregoing design methods can implement a layout of 4*4 MIMO antenna in intermediate and high frequency communication frequency bands and a Wi-Fi frequency band. In addition, compared with a conventional solution, multi-feed antennas are used, directivity of the GPS antenna and the Wi-Fi antenna and multi-carrier aggregation performance of communication frequency bands (for example, LTE B3+LTE B7+LTE B20) are also improved and optimized.

Figure 11:
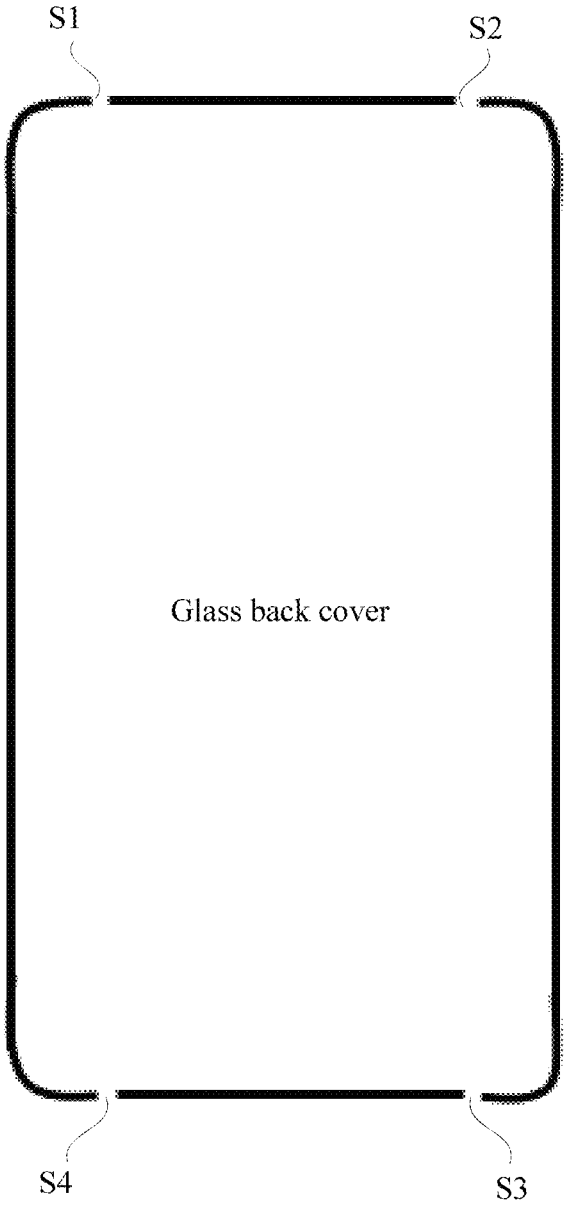
FIG. 11 is a second schematic structural diagram of a communications terminal according to an embodiment of the present invention.
Figure 12:
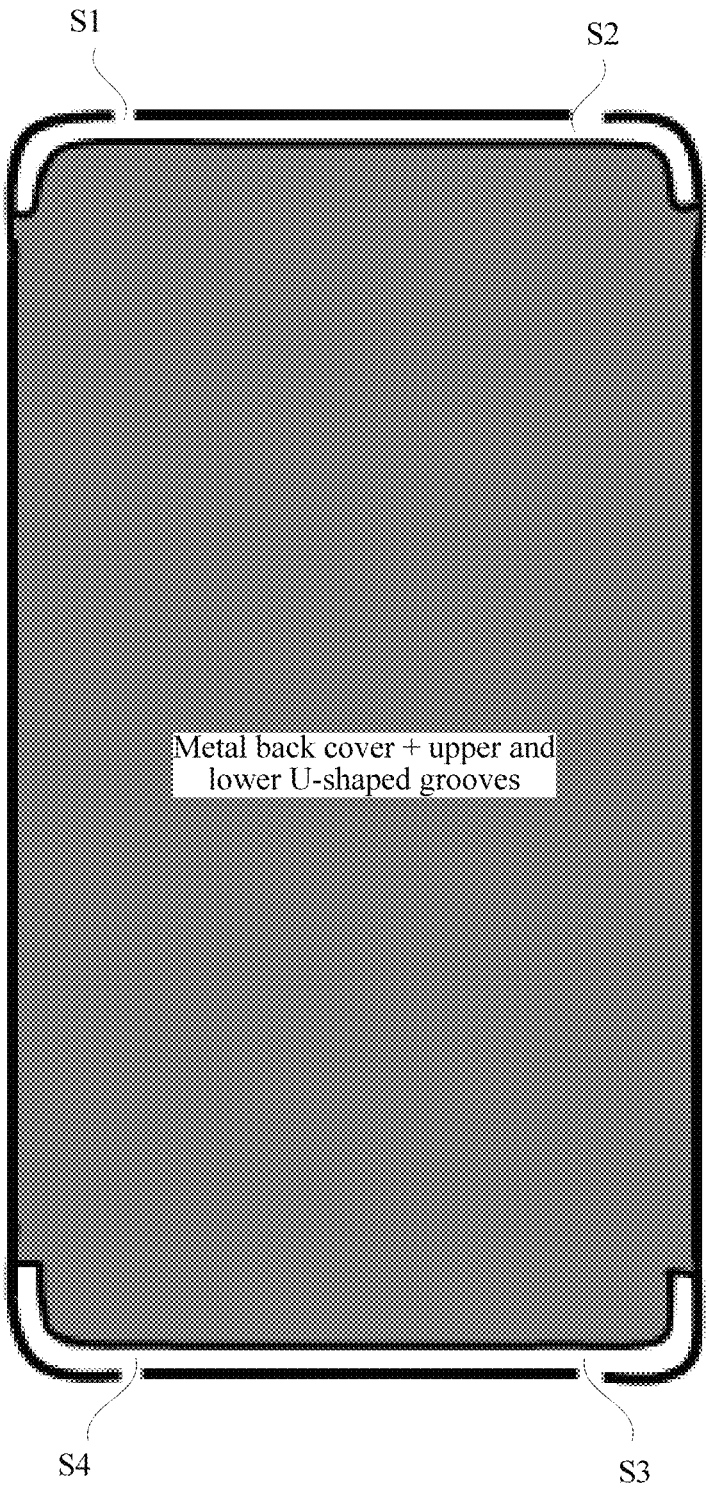
FIG. 12 is a third schematic structural diagram of a communications terminal according to an embodiment of the present invention.
Figure 13:
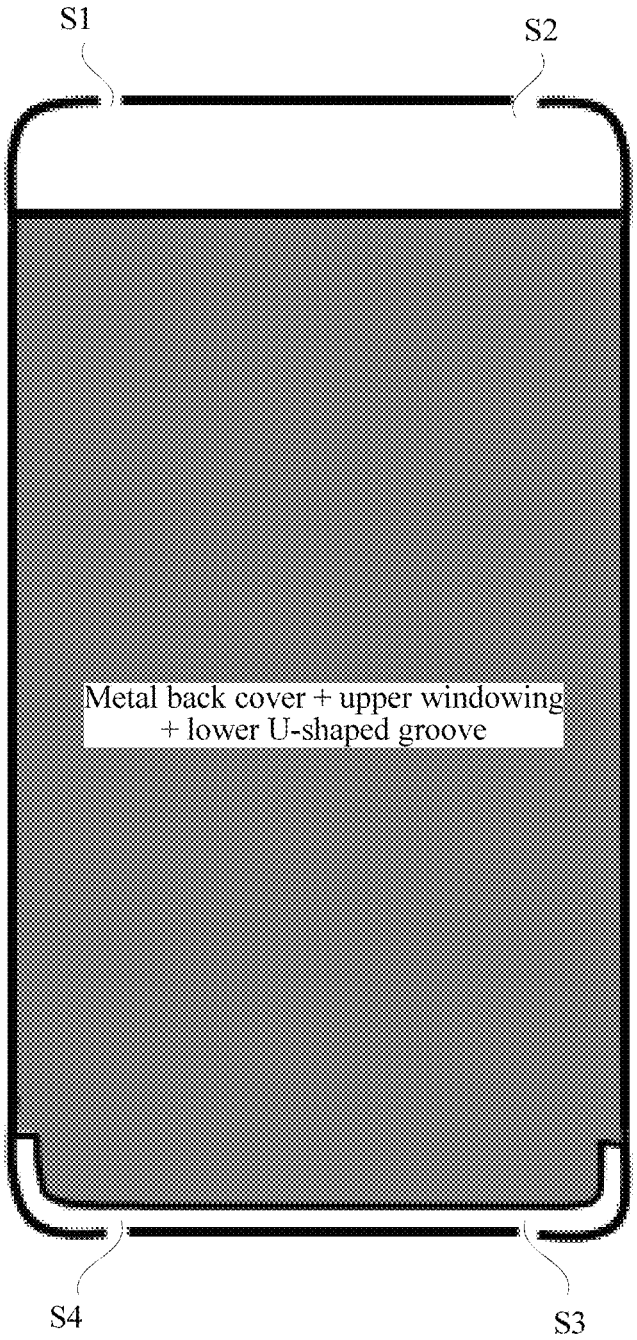
FIG. 13 is a fourth schematic structural diagram of a communications terminal according to an embodiment of the present invention.
Figure 14:
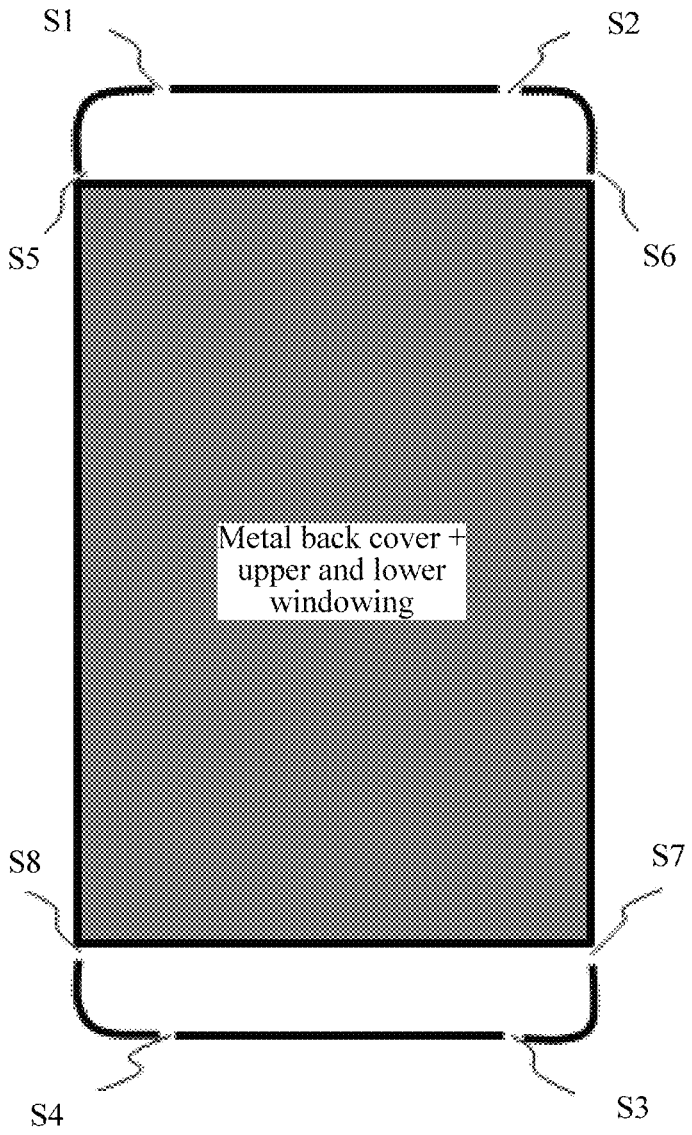
FIG. 14 is a fifth schematic structural diagram of a communications terminal according to an embodiment of the present invention.
Figure 15:
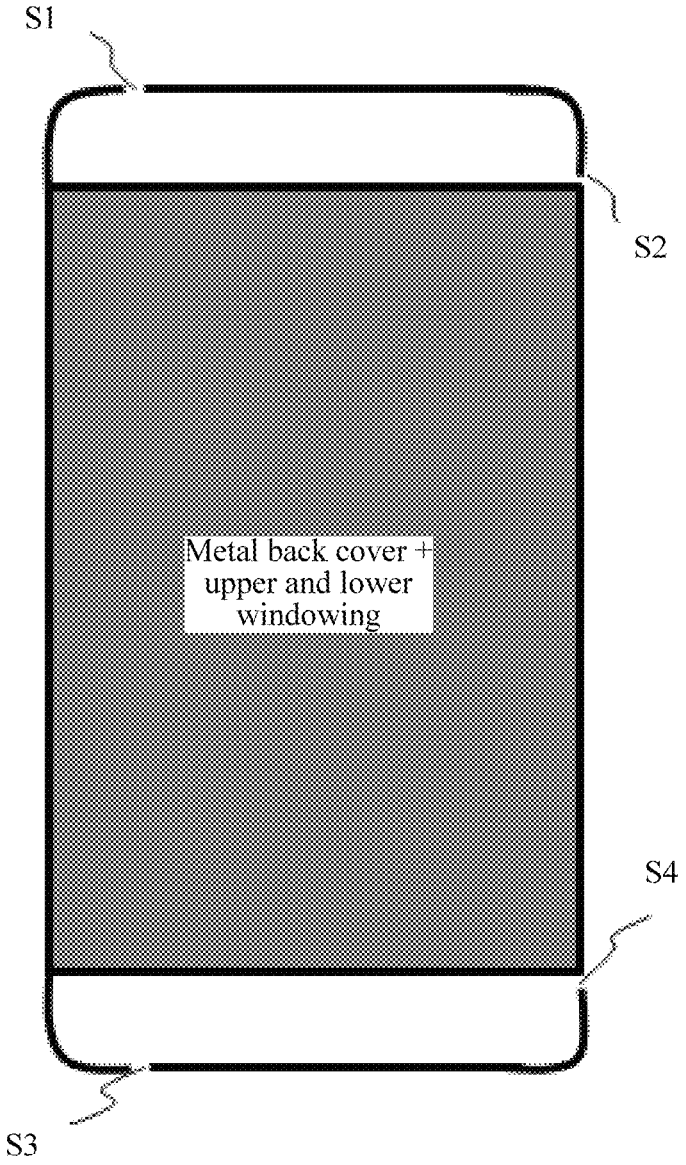
FIG. 15 is a sixth schematic structural diagram of a communications terminal according to an embodiment of the present invention.
Figure 16:
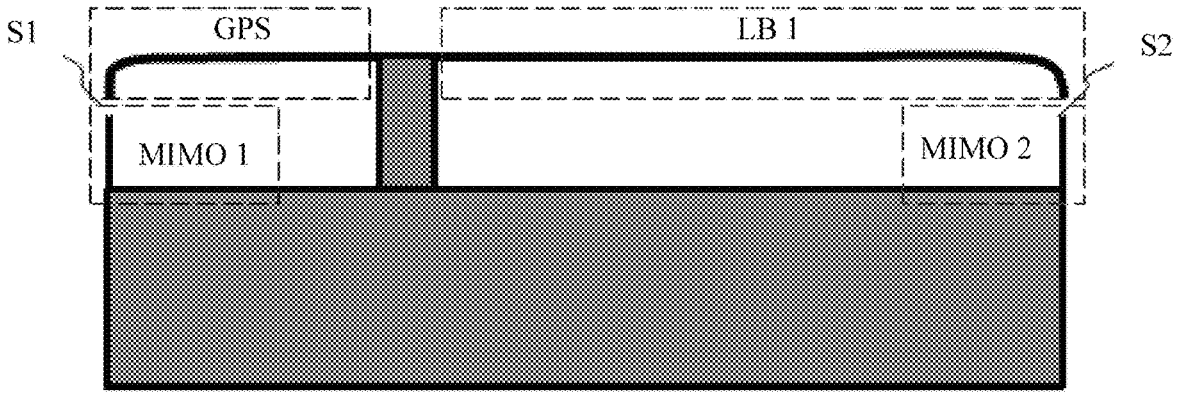
FIG. 16 is a seventh schematic structural diagram of a communications terminal according to an embodiment of the present invention.

It may be understood that in addition to the communications terminal 100 that has a window structure and the metal frame and that is described in the foregoing embodiment, the multiple-input multiple-output antenna system 10 provided in the embodiments of the present invention may further be applied to another communications terminal in which an antenna radiator is implemented by using a metal appearance structure, for example, a structure (shown in FIG. 11) having a metal frame and a glass back cover, a metal frame structure (shown in FIG. 12) having upper and lower U-shaped grooves, and a structure (shown in FIG. 13) having a combination of the foregoing metal frames. In addition, for the communications terminal to which the multiple-input multiple-output antenna system 10 provided in the embodiments of the present invention is applied, a location at which a slit is provided on the metal frame may further use different solutions based on coverage of a frequency band and a design requirement. For example, both two antenna modules are detached into double-feed antennas, and two slits are provided at each of a top surface and a side surface of the metal frame. As shown in FIG. 14, in addition to S1 and S2 shown in FIG. 4 and S3 and S4 shown in FIG. 8, S5 and S6 that are located on two sides of the metal frame and that are adjacent to the top of the communications terminal and S7 and S8 that are located on two sides of the metal frame and that are adjacent to the bottom of the communications terminal are further included. Optionally, if a communications antenna module is designed to be a single-feed antenna, a slit is provided at each of the top metal frame and a side of metal frame of the communications terminal, as shown in FIG. 15. It may be understood that the multiple-input multiple-output antenna system 10 provided in the embodiments of the present invention may also be applied to a design in which a part of a metal appearance structure (that is, the metal frame of the communications terminal) is used as an antenna radiator or in which no metal appearance structure is used as an antenna radiator. For example, parts of the first MIMO antenna and the second MIMO antenna shown in FIG. 7 are implemented by using a metal appearance structure, and both the GPS antenna and the first low frequency communications antenna are implemented by using a metal appearance structure, a similar metal frame design in which only a side slit is provided may be implemented, as shown in FIG. 16. It may be understood that the foregoing examples are merely used for describing diversity of location design of a slit on the metal frame, and do not constitute a limitation on the location of the slit on the metal frame.

If the metal frame design shown in FIG. 14 is used, the first radiator 111 is a part of the top metal frame 1011 and a part of the first-side metal frame 1013 that are of the communications terminal, the second radiator 112 and the third radiator 121 are parts of the top metal frame 1011 of the communications terminal, and the fourth radiator 122 is a part of the top metal frame 1011 and a part of the second-side metal frame 1014 that are of the communications terminal. A fifth slit S5 is provided between the part of the first-side metal frame 1013 used as the first radiator 111 and the remaining first-side metal frame 1013, and a sixth slit S6 is provided between the part of the second-side metal frame 1014 used as the fourth radiator 122 and the remaining second-side metal frame 1014.

The fifth radiator 141 is a part of the bottom metal frame 1012 and a part of the second-side metal frame 1014 that are of the communications terminal, the sixth radiator 142 and the seventh radiator 151 are parts of the bottom metal frame 1012 of the communications terminal, the eighth radiator 152 is a part of the bottom metal frame 1012 and a part of the first-side metal frame 1013 that are of the communications terminal, a seventh slit S7 is provided between the part of the second-side metal frame 1014 used as the fifth radiator 141 and the remaining second-side metal frame 1014, and an eighth slit S8 is provided between the part of the first-side metal frame 1013 used as the eighth radiator 152 and the remaining first-side metal frame 1013. It may be understood that if the metal frame designs shown in FIG. 11, FIG. 12, FIG. 13, and FIG. 15 are used, a layout of each radiator in the multiple-input multiple-output antenna system 10 is similar to the metal frame design shown in FIG. 14, and details are not described herein again.

If the metal frame design shown in FIG. 16 is used, the first radiator 111 is a part of the first-side metal frame 1013 of the communications terminal, the second radiator 112 is a part of the top metal frame 1011 and a part of the first-side metal frame 1013 that are of the communications terminal, the third radiator 121 is a part of the top metal frame 1011 and a part of the second-side metal frame 1014 that are of the communications terminal, and the fourth radiator 122 is a part of the second-side metal frame 1014 of the communications terminal.

The fifth radiator 141 is a part of the second-side metal frame 1014 of the communications terminal, the sixth radiator 142 is a part of the bottom metal frame 1012 and a part of the second-side metal frame 1014 that are of the communications terminal, the seventh radiator 151 is a part of the bottom metal frame 1012 and a part of the first-side metal frame 1013 that are of the communications terminal, and the eighth radiator 152 is a part of the first-side metal frame 1013 of the communications terminal.

Figure 17:
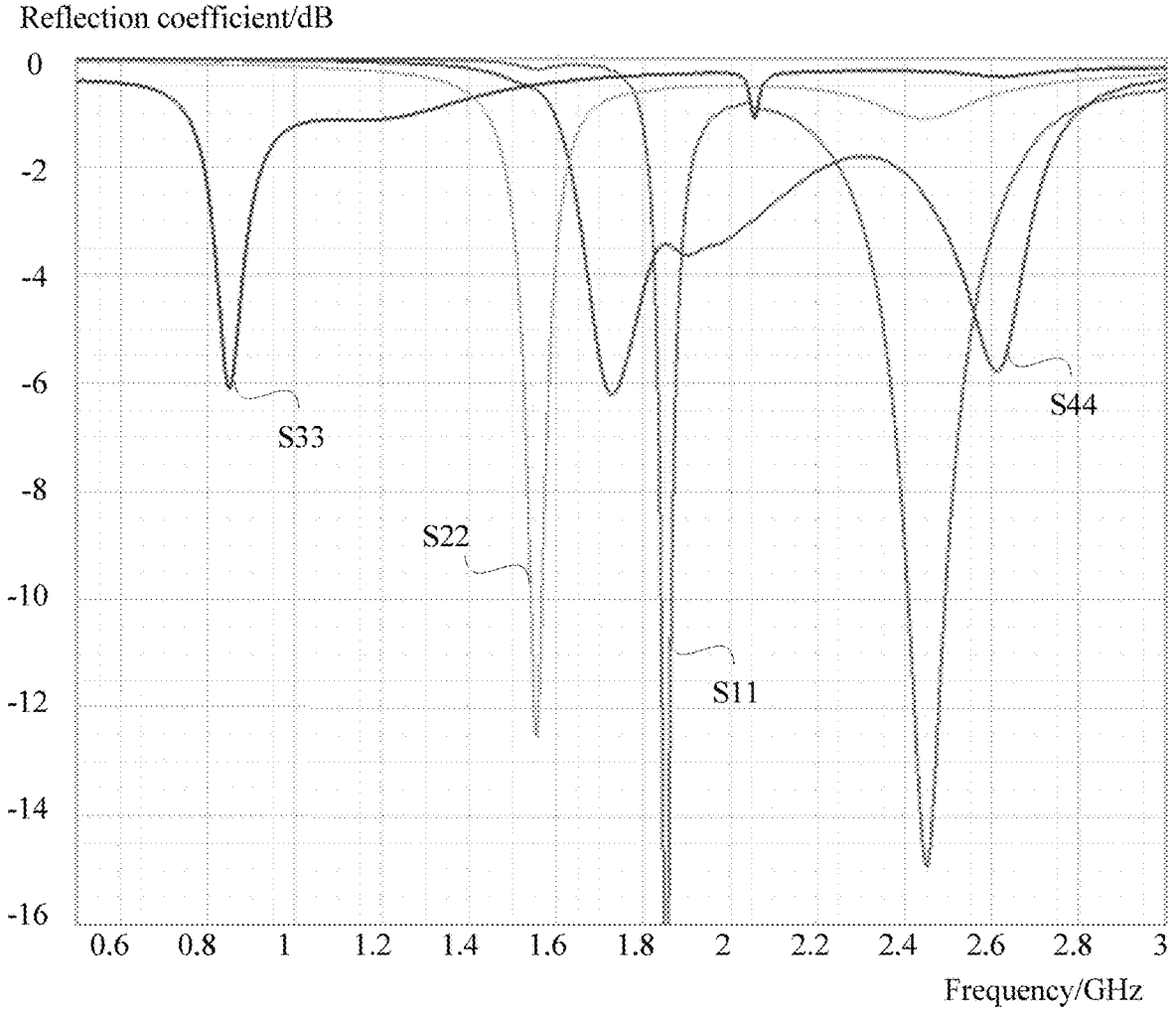
FIG. 17 is a schematic curve chart of a reflection coefficient of a top antenna system of a communications terminal according to an embodiment of the present invention.
Figure 18:
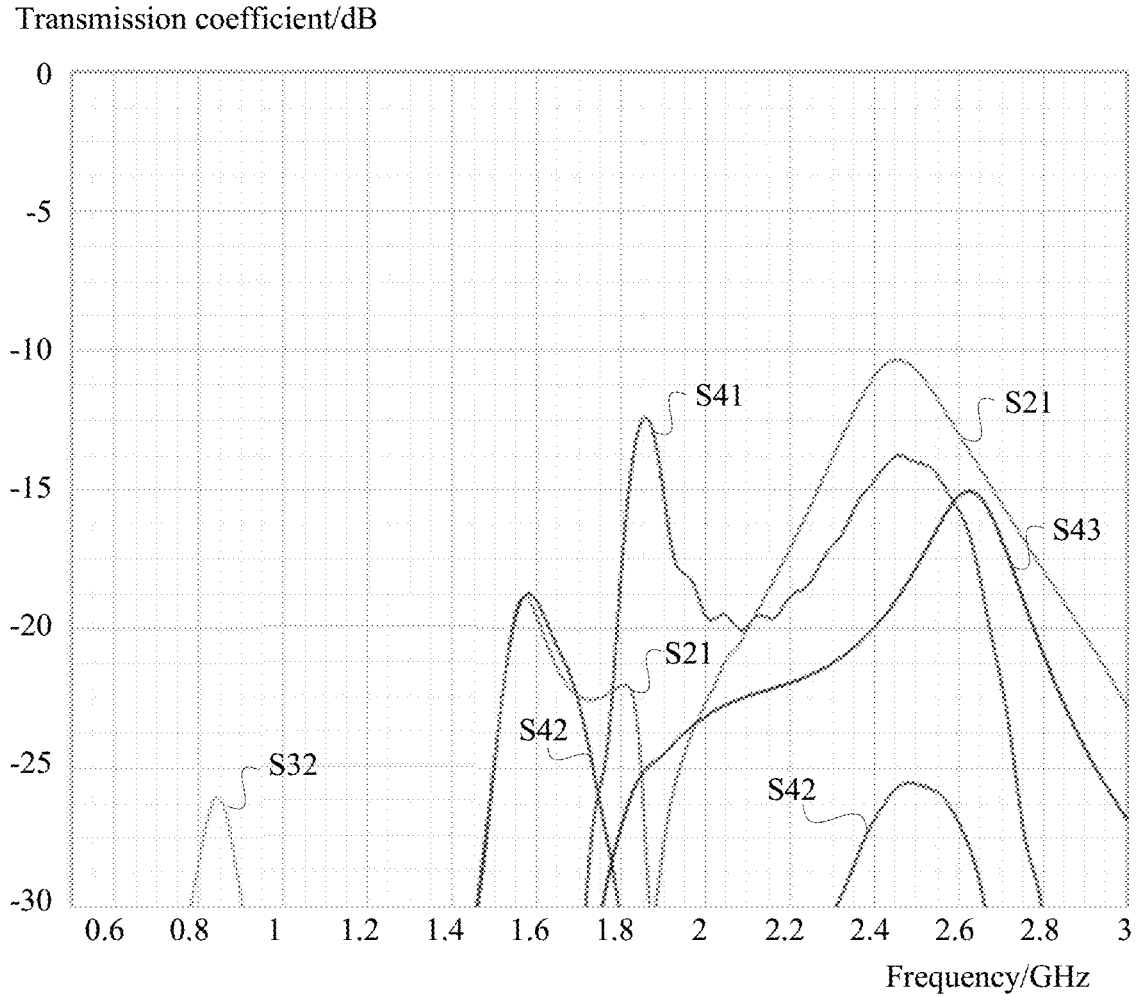
FIG. 18 is a schematic curve chart of a transmission coefficient of a top antenna system of a communications terminal according to an embodiment of the present invention.
Figure 19:
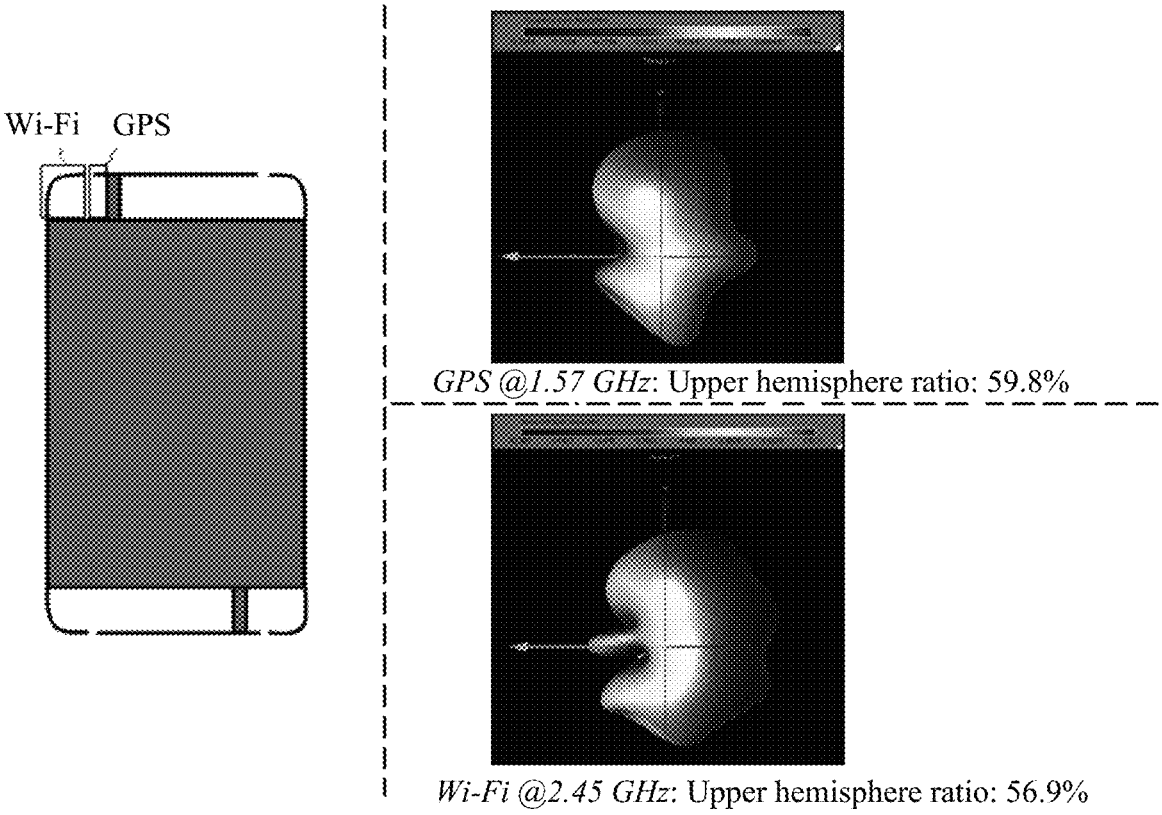
FIG. 19 shows directivity patterns of a Wi-Fi antenna and a GPS antenna of a top antenna system of a communications terminal according to an embodiment of the present invention.
Figure 20:
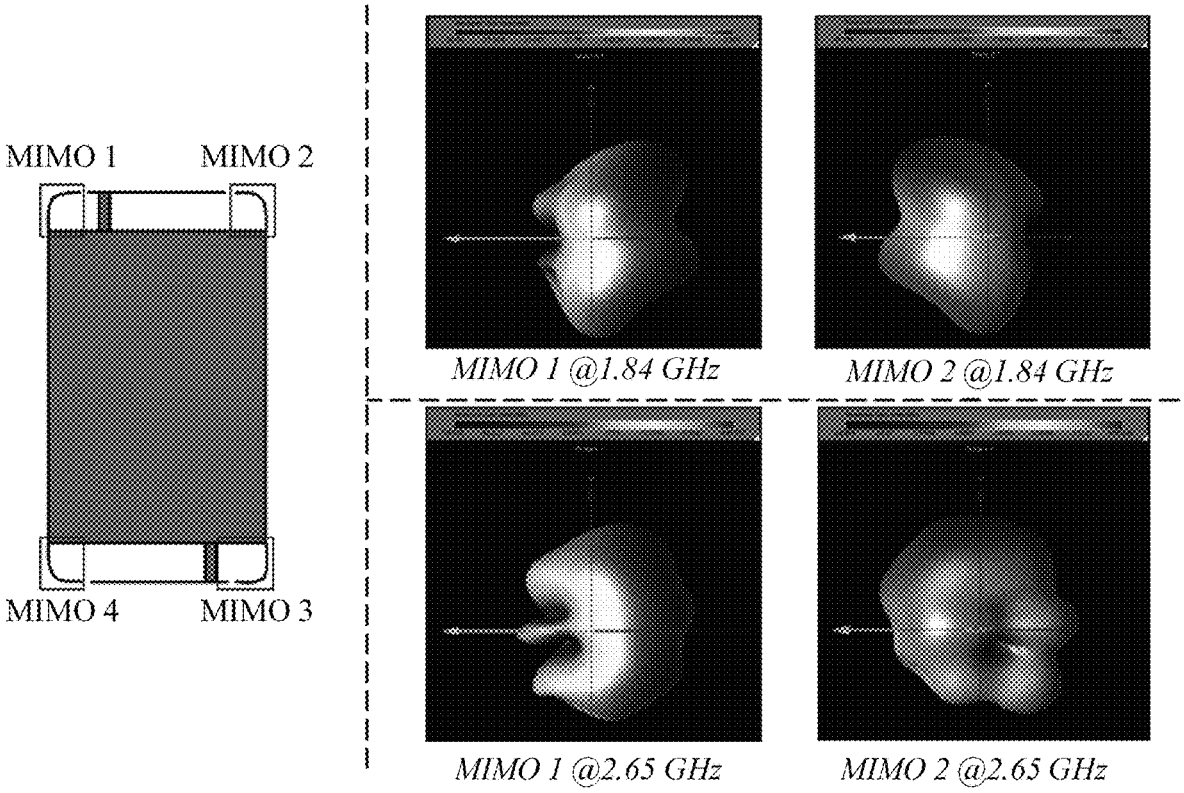
FIG. 20 shows directivity patterns of a MIMO 1 antenna and a MIMO 2 antenna of a top antenna system of a communications terminal according to an embodiment of the present invention.

Referring to FIG. 17, for the first antenna module 11 and the second antenna module 12 located on the top of the communications terminal 100 shown in FIG. 7, simulation is performed on the first feeding port 1, the second feeding port 2, the third feeding port 3, and the fourth feeding port 4 to obtain antenna reflection coefficients. The antenna reflection coefficients respectively are curves S11, S22, S33, and S44 shown in the figure. Antennas at the port 1 and the port 4 use a broadband matching design, so that frequency band requirements of the MIMO antennas in an LTE B3 frequency band+an LTE B7 frequency band+a Wi-Fi frequency band can be separately satisfied. Curves S21, S32, S41, S42, and S43 shown in FIG. 18 respectively are transmission coefficient curves between the feeding ports. S31 is not shown in FIG. 18 because S31 is less than −30 dB. The transmission coefficient curves reflect that antenna isolation is all above 10 dB. FIG. 19 shows directivity patterns of the GPS antenna and the MIMO 1 antenna, and FIG. 20 shows directivity patterns of two top MIMO antennas in an LTE B3 frequency band and an LTE B7 frequency band. It may be learned from FIG. 19 and FIG. 20 that upper hemisphere ratios of the GPS antenna and the Wi-Fi antenna are close to 60%, and the directivity patterns of the two MIMO antennas have desirable complementarity.

Figure 21:
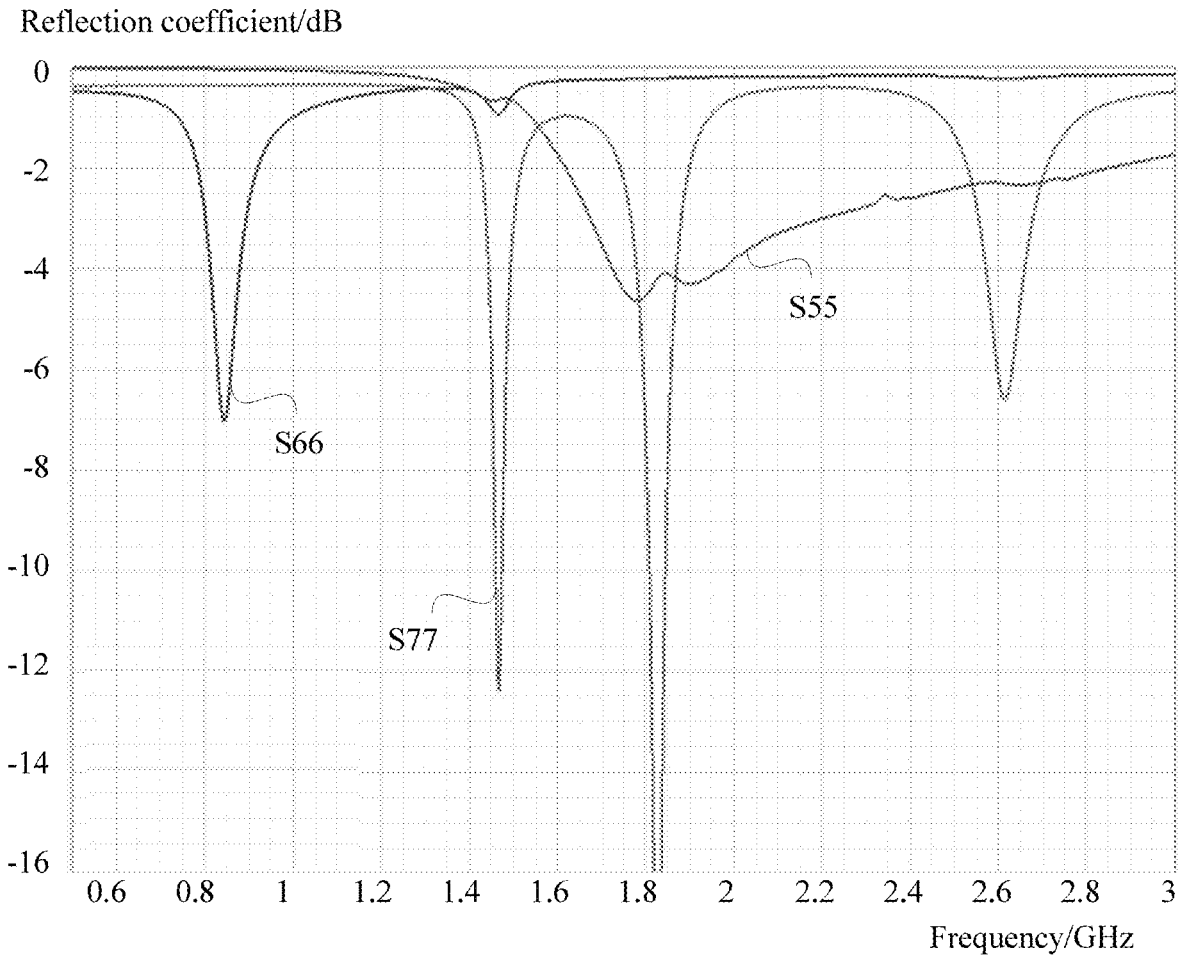
FIG. 21 is a schematic curve chart of a reflection coefficient of a bottom antenna system of a communications terminal according to an embodiment of the present invention.
Figure 22:
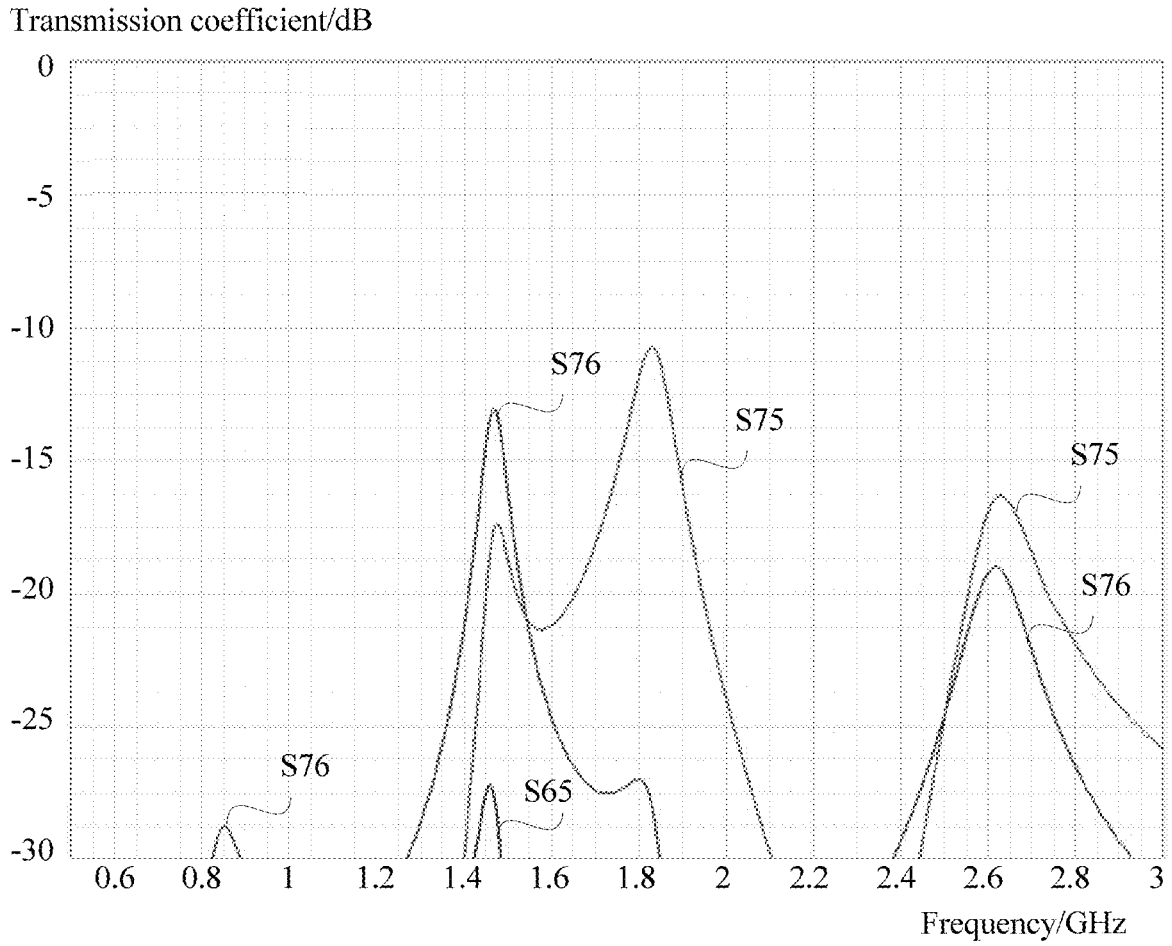
FIG. 22 is a schematic curve chart of a transmission coefficient of a bottom antenna system of a communications terminal according to an embodiment of the present invention.
Figure 23:
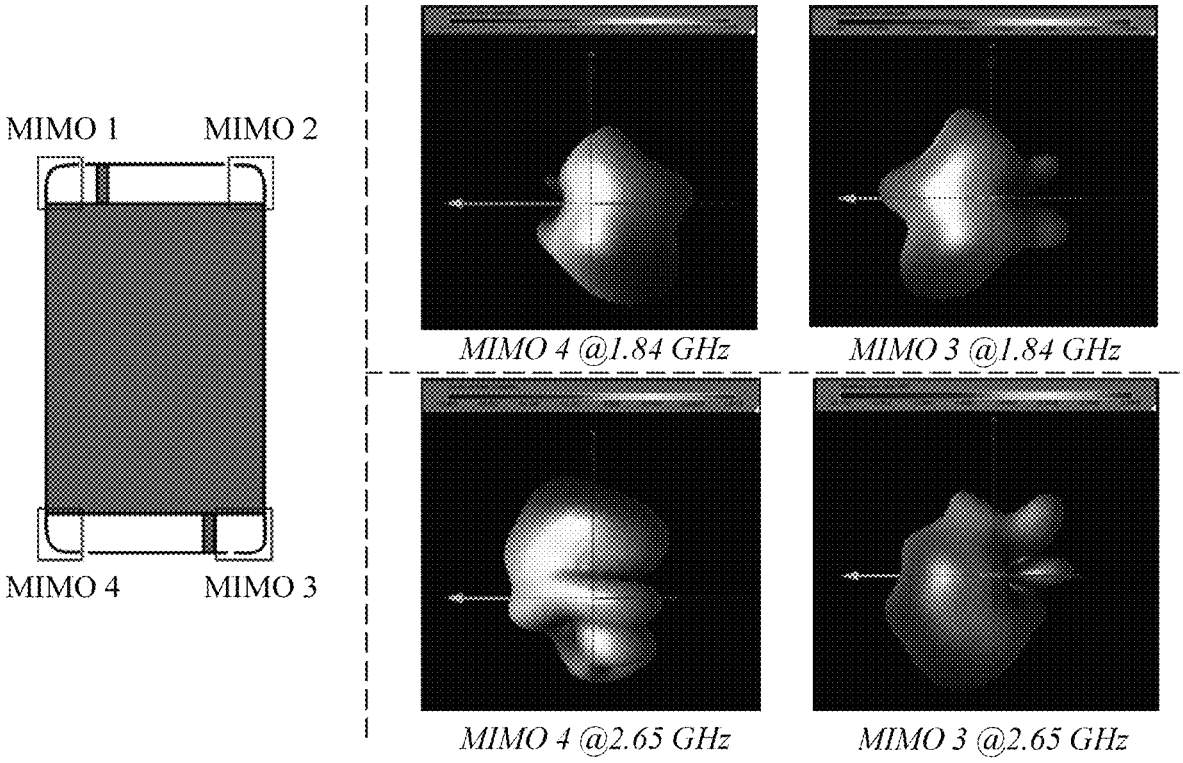
FIG. 23 shows directivity patterns of a MIMO 3 antenna and a MIMO 4 antenna of a bottom antenna system of a communications terminal according to an embodiment of the present invention.

Referring to FIG. 21, for the third antenna module 14 and the fourth antenna module 15 at the bottom of the communications terminal 100 shown in FIG. 10, simulation is performed on the fifth feeding port 5, the sixth feeding port 6, and the seventh feeding port 7 to obtain antenna reflection coefficients. The antenna reflection coefficients respectively are curves S55, S66, and S77 shown in the figure. An antenna at the port 7 uses the broadband matching design, and an antenna at the port 5 use a design of a feeding unit and a coupling unit (the sixth radiator 142), so that frequency band requirements of the MIMO antennas in the LTE B3 frequency band+the LTE B7 frequency band+the Wi-Fi frequency band can be separately satisfied. Curves S65, S75, and S76 shown in FIG. 22 respectively are transmission coefficient curves between the feeding ports. The curves reflect that the antenna isolation is all above 10 dB. FIG. 23 shows directivity patterns of two bottom MIMO antennas in of the LTE B3 frequency band and the LTE B7 frequency band. It may be learned from the figure that the directivity patterns of the two bottom MIMO antennas also have desirable complementarity. It may be understood that in the embodiments of the present invention, specific forms of antennas used to form the antenna modules are not limited. For example, the antennas may be inverted-F antennas (IFA), planar inverted-F antennas (PIFA), or loop antennas. In the simulation embodiments shown in FIG. 17 to FIG. 23, an IFA antenna form is used for simulation and description.

The multiple-input multiple-output antenna system of the communications terminal provided in the embodiments of the present invention not only satisfies requirements of a current communications network, but also implements a 4*4 MIMO antenna layout in the intermediate and high frequency communication frequency bands and the Wi-Fi frequency band, so that isolation of the system is optimized. Directivity patterns are well complementary due to a location relationship between the MIMO antennas, and gains of the MIMO antenna system are significant. In addition, a method for designing a multi-feed antenna inside an antenna module is used, so that the upper hemisphere ratios of the GPS antenna and the Wi-Fi antenna may be usually close to 60%. In addition, relatively desirable multi-carrier aggregation performance can be implemented in the LTE communication frequency bands. It may be understood that the multiple-input multiple-output antenna system may be applied to various compact terminals, and only at least four slits need to be provided at a metal frame.

What is disclosed above is merely example embodiments of the present invention, and certainly is not intended to limit the protection scope of the present invention. A person of ordinary skill in the art may understand that all or some of processes that implement the foregoing embodiments and equivalent modifications made in accordance with the claims of the present invention shall fall within the scope of the present invention.

What is claimed is:

1. A communications terminal, comprising a multiple-input multiple-output (MIMO) antenna system, wherein the MIMO antenna system comprises:

a first antenna module comprising a first radiator, a second radiator, a first slit between the first radiator and the second radiator, a first feeding port, and a second feeding port, wherein the first feeding port is connected to the first radiator and feeds a first signal source, the first feeding port forming a first MIMO antenna together with the first radiator, and wherein the second feeding port is connected to the second radiator and feeds a second signal source, the second feeding port forming a GPS antenna together with the second radiator;

a second antenna module comprising a third radiator and a fourth radiator, wherein the second radiator is connected to the third radiator, the first radiator is located on one side of the second radiator opposite to the third radiator, and the fourth radiator is located on one side of the third radiator opposite to the second radiator, wherein the third radiator is part of a first low frequency communications antenna, and the fourth radiator is part of a second MIMO antenna; and a first ground structure having one end connected to the second radiator or the third radiator and another end connected to a ground plane of the communications terminal.

2. The communications terminal according to claim 1, wherein the first ground structure increases isolation between the first antenna module and the second antenna module.

3. The communications terminal according to claim 1, wherein the first antenna module further comprises a first band-pass filter connected in parallel with the second feeding port to increase isolation between the first radiator and the second radiator.

4. The communications terminal according to claim 1, wherein the second antenna module further comprises:

a third feeding port connected to the third radiator and feeding a third signal source, the third feeding port forming the first low frequency communications antenna together with the third radiator;

a fourth feeding port connected to the fourth radiator and feeding a fourth signal source, the fourth feeding port forming the second MIMO antenna together with the fourth radiator; and a second slit provided between the third radiator and the fourth radiator to increase isolation between the third radiator and the fourth radiator.

5. The communications terminal according to claim 4, wherein the second antenna module further comprises a second band-pass filter connected in parallel with the third feeding port to increase the isolation between the third radiator and the fourth radiator.

6. The communications terminal according to claim 1, wherein a frequency band covered by the first low frequency communications antenna covers 700 MHz to 960 MHz, and a frequency band covered by the first MIMO antenna and the second MIMO antenna covers 170 MHz to 270 MHz.

7. A communications terminal, comprising a multiple-input multiple-output (MIMO) antenna system, wherein the MIMO antenna system comprises:

a first antenna module comprising a first radiator, a second radiator, a first slit between the first radiator and the second radiator, a first feeding port, and a second feeding port, wherein the first feeding port is connected to the first radiator and feeds a first signal source, the first feeding port forming a first MIMO antenna together with the first radiator, and wherein the second feeding port is connected to the second radiator and feeds a second signal source, the second feeding port forming a GPS antenna together with the second radiator;

a second antenna module comprising a third radiator and a fourth radiator, wherein the second radiator is connected to the third radiator, the first radiator is located on one side of the second radiator opposite to the third radiator, and the fourth radiator is located on one side of the third radiator opposite to the second radiator, wherein the third radiator is part of a first low frequency communications antenna, and the fourth radiator is part of a second MIMO antenna;

a first ground structure having one end connected to the second radiator or the third radiator and another end connected to a ground plane of the communications terminal;

a third antenna module comprising a fifth radiator, a sixth radiator, and a third slit provided between the fifth radiator and the sixth radiator;

a fourth antenna module comprising a seventh radiator and an eighth radiator, wherein the sixth radiator is connected to the seventh radiator, the fifth radiator is located on one side of the sixth radiator opposite to the seventh radiator, and the eighth radiator is located on one side of the seventh radiator opposite to the sixth radiator, the fifth radiator and the sixth radiator being part of a third MIMO antenna, the seventh radiator being a second low frequency communications antenna, and the eighth radiator being part of a fourth MIMO antenna; and a second ground structure with one end connected to the sixth radiator or the seventh radiator, and another end connected to the ground plane of the communications terminal, to increase isolation between the third antenna module and the fourth antenna module.

8. The communications terminal according to claim 7, wherein the third antenna module further comprises a fifth feeding port connected to the fifth radiator and feeds a fifth signal source, the fifth feeding port forming the third MIMO antenna together with the fifth radiator and the sixth radiator, wherein the sixth radiator is coupled to the fifth radiator through the third slit.

9. The communications terminal according to claim 7, wherein the fourth antenna module further comprises:

a sixth feeding port connected to the seventh radiator and feeding a sixth signal source, the sixth feeding port forming the second low frequency communications antenna together with the seventh radiator;

a seventh feeding port connected to the eighth radiator and feeding a seventh signal source, the seventh feeding port forming the fourth MIMO antenna together with the eighth radiator; and a fourth slit provided between the seventh radiator and the eighth radiator, to increase isolation between the seventh radiator and the eighth radiator.

10. The communications terminal according to claim 9, wherein the fourth antenna module further comprises a third band-pass filter connected in parallel with the sixth feeding port, to increase the isolation between the seventh radiator and the eighth radiator.

11. The communications terminal according to claim 7, wherein a frequency band covered by the second low frequency communications antenna comprises at least 700 MHz to 960 MHz, and a frequency band covered by the third MIMO antenna and the fourth MIMO antenna comprises at least 1700 MHz to 2700 MHz.

12. A communications terminal, comprising a multiple-input multiple-output (MIMO) antenna system and a metal frame;

wherein the MIMO antenna system comprises:

a first antenna module comprising a first radiator, a second radiator, a first slit between the first radiator and the second radiator, a first feeding port, and a second feeding port, wherein the first feeding port is connected to the first radiator and feeds a first signal source, the first feeding port forming a first MIMO antenna together with the first radiator, and wherein the second feeding port is connected to the second radiator and feeds a second signal source, the second feeding port forming a GPS antenna together with the second radiator;

a second antenna module comprising a third radiator and a fourth radiator, wherein the second radiator is connected to the third radiator, the first radiator is located on one side of the second radiator opposite to the third radiator, and the fourth radiator is located on one side of the third radiator opposite to the second radiator, wherein the third radiator is part of a first low frequency communications antenna, and the fourth radiator is part of a second MIMO antenna; and a first ground structure having one end connected to the second radiator or the third radiator and another end connected to a ground plane of the communications terminal; and wherein the metal frame comprises:

a top metal frame;

a bottom metal frame, the top metal frame and the bottom metal frame being disposed opposite to each other;

a first-side metal frame; and a second-side metal frame, the first-side metal frame and the second-side metal frame being respectively connected to two ends of the top metal frame and the bottom metal frame, wherein the first radiator, the second radiator, the third radiator and the fourth radiator are each part of the metal frame.

13. The communications terminal according to claim 12, wherein the first radiator is part of the top metal frame and part of the first-side metal frame that are of the communications terminal;

wherein the second radiator and the third radiator are parts of the top metal frame of the communications terminal;

wherein the fourth radiator includes part of the top metal frame and part of the second-side metal frame that are of the communications terminal; and wherein a fifth slit is provided between the part of the first-side metal frame used as the first radiator and the remaining first-side metal frame, and a sixth slit is provided between the part of the second-side metal frame used as the fourth radiator and the remaining second-side metal frame.

14. The communications terminal according to claim 12, wherein the first radiator is part of the first-side metal frame of the communications terminal;

the second radiator is part of the top metal frame of the communications terminal;

the third radiator is part of the top metal frame of the communications terminal; and the fourth radiator is part of the second-side metal frame of the communications terminal.

15. The communications terminal according to claim 12, wherein the MIMO antenna system further comprises:

a third antenna module comprising a fifth radiator, a sixth radiator, and a third slit provided between the fifth radiator and the sixth radiator;

a fourth antenna module comprising a seventh radiator and an eighth radiator, wherein the sixth radiator is connected to the seventh radiator, the fifth radiator is located on one side of the sixth radiator opposite to the seventh radiator, and the eighth radiator is located on one side of the seventh radiator opposite to the sixth radiator, the fifth radiator and the sixth radiator being part of a third MIMO antenna, the seventh radiator being part of a second low frequency communications antenna, and the eighth radiator being part of a fourth MIMO antenna; and a second ground structure with one end connected to the sixth radiator or the seventh radiator, and another end connected to a ground plane of the communications terminal, to increase isolation between the third antenna module and the fourth antenna module;

wherein the fifth radiator, the sixth radiator, the seventh radiator and the eighth radiator are each part of the metal frame.

16. The communications terminal according to claim 15, wherein the fifth radiator includes part of the second-side metal frame of the communications terminal;

wherein the sixth radiator and the seventh radiator are parts of the bottom metal frame of the communications terminal;

wherein the eighth radiator part of the first-side metal frame of the communications terminal;

wherein a seventh slit is provided between the part of the second-side metal frame used as the fifth radiator and a remaining second-side metal frame; and wherein an eighth slit is provided between the part of the first-side metal frame used as the eighth radiator and a remaining first-side metal frame.

17. The communications terminal according to claim 15, wherein the fifth radiator is part of the second-side metal frame of the communications terminal;

the sixth radiator is part of the bottom metal frame of the communications terminal;

the seventh radiator is part of the bottom metal frame of the communications terminal; and the eighth radiator is part of the first-side metal frame of the communications terminal.

* * * * *